US009440206B2

(12) United States Patent
Cuting

(10) Patent No.: US 9,440,206 B2
(45) Date of Patent: Sep. 13, 2016

(54) MIXING OF THE CONTENT OF A FLEXIBLE CONTAINER FOR BIOPHARMACEUTICAL USE

(75) Inventor: Jonathan Cuting, Fairfield, CA (US)

(73) Assignee: SARTORIUS STEDIM FMT SAS, Aubagne (FR)

( * ) Notice: Subject to any disclaimer, the term of this patent is extended or adjusted under 35 U.S.C. 154(b) by 624 days.

(21) Appl. No.: 13/997,535

(22) PCT Filed: Dec. 21, 2011

(86) PCT No.: PCT/FR2011/053141

§ 371 (c)(1),
(2), (4) Date: Aug. 2, 2013

(87) PCT Pub. No.: WO2012/085470

PCT Pub. Date: Jun. 28, 2012

(65) Prior Publication Data

US 2013/0308418 A1 Nov. 21, 2013

(30) Foreign Application Priority Data

Dec. 22, 2010 (FR) ..... 10 61091

(51) Int. Cl.
*B01F 11/00* (2006.01)
*B01F 15/00* (2006.01)

(52) U.S. Cl.
CPC ..... *B01F 11/0065* (2013.01); *B01F 11/0045* (2013.01); *B01F 11/0071* (2013.01); *B01F 15/0085* (2013.01); *B01F 15/00831* (2013.01)

(58) Field of Classification Search
CPC ..... B01F 11/0065
USPC ..... 366/106–107, 163.1, 275
See application file for complete search history.

(56) References Cited

U.S. PATENT DOCUMENTS 3,819,158 A * 6/1974 Sharpe ..... B01F 11/0065 206/221
4,793,714 A * 12/1988 Gruber ..... B01F 3/04978 261/122.1

(Continued)

FOREIGN PATENT DOCUMENTS

EP 1 837 640 9/2007
WO 93/10895 6/1993

(Continued)

OTHER PUBLICATIONS

International Search Report dated Mar. 28, 2013 in corresponding PCT application.

(Continued)

*Primary Examiner* — David Sorkin
*Assistant Examiner* — Abbas Rashid
(74) *Attorney, Agent, or Firm* — Young & Thompson

(57) ABSTRACT

A receptacle (1) for biopharmaceutical use includes a flexible container (2) having a wall (4), an internal space (5) for receiving a liquid or pasty biopharmaceutical content, mixing elements (20) adjacent to a given portion (21) of the wall (4), elements (22) for rigid and leaktight connection between the mixing elements (20) and the given portion (21), the mixing elements (20) including a sleeve (24), a suction-delivery opening (26), a suction-delivery part (28), a suction-delivery cavity (29), drive elements (23) for driving in an alternating forward/backward axial sliding sequence, elements (32) for immobilizing the sleeve and the given portion (21), including during the axial sliding movement of the suction-delivery part (28).

24 Claims, 13 Drawing Sheets

(56) References Cited

U.S. PATENT DOCUMENTS 5,078,504 A * 1/1992 Landa ..... B01F 3/0819 366/118
5,456,586 A * 10/1995 Carson ..... B01F 7/22 264/328.6
5,758,823 A 6/1998 Glezer et al.
5,894,990 A 4/1999 Glezer et al.
5,957,413 A 9/1999 Glezer et al.
5,988,422 A 11/1999 Vallot
5,988,522 A 11/1999 Glezer et al.
6,056,204 A 5/2000 Glezer et al.
6,123,145 A 9/2000 Glezer et al.
6,439,759 B1 * 8/2002 Ray ..... B01F 11/0065 366/197
6,457,654 B1 10/2002 Glezer et al.
6,908,223 B2 * 6/2005 Bibbo ..... A61L 2/02 366/333
6,923,567 B2 * 8/2005 Bibbo ..... A61L 2/02 366/149
6,981,794 B2 * 1/2006 Bibbo ..... A61L 2/02 366/149
7,384,027 B2 * 6/2008 Terentiev ..... B01F 3/04248 261/122.1
7,789,551 B2 * 9/2010 Ray ..... B01F 11/0065 141/77
7,972,058 B2 * 7/2011 Furey ..... B01F 11/0071 366/275
8,328,409 B2 * 12/2012 Whitney ..... B01F 5/0206 366/107
8,342,737 B2 * 1/2013 Greller ..... B01F 3/04262 366/102
2005/0002274 A1 * 1/2005 Terentiev ..... B01F 1/0011 366/273
2006/0092761 A1 * 5/2006 Terentiev ..... B01F 7/162 366/274
2006/0196501 A1 * 9/2006 Bibbo ..... C12M 23/14 128/200.23
2006/0270036 A1 * 11/2006 Goodwin ..... B01F 3/04269 435/395
2007/0290381 A1 * 12/2007 Denney ..... B01D 21/0093 261/121.1
2008/0008028 A1 * 1/2008 Terentiev ..... B01F 7/162 366/273
2009/0275121 A1 * 11/2009 Greller ..... B01F 3/04262 435/295.1
2010/0157725 A1 * 6/2010 Terentiev ..... B01F 7/162 366/331
2010/0275611 A1 * 11/2010 Prabhu ..... F02C 7/222 60/780
2011/0026360 A1 2/2011 Greller et al.

FOREIGN PATENT DOCUMENTS

WO 00/04131 1/2000
WO 02/062458 A1 8/2002
WO 2006/002091 A2 1/2006
WO 2006/063087 A2 6/2006
WO 2006/136999 12/2006
WO 2009/143925 A2 12/2009
WO 03/028869 A2 4/2013

OTHER PUBLICATIONS

P. S. Krueger; "Vortex Rings in Bio-inspired and Biological Jet Propulsions"; Advances in Science and Technology, vol. 58 (2008), pp. 237-246; Trans Tech Publications, Switzerland (online at http://www.scientific.net).

* cited by examiner

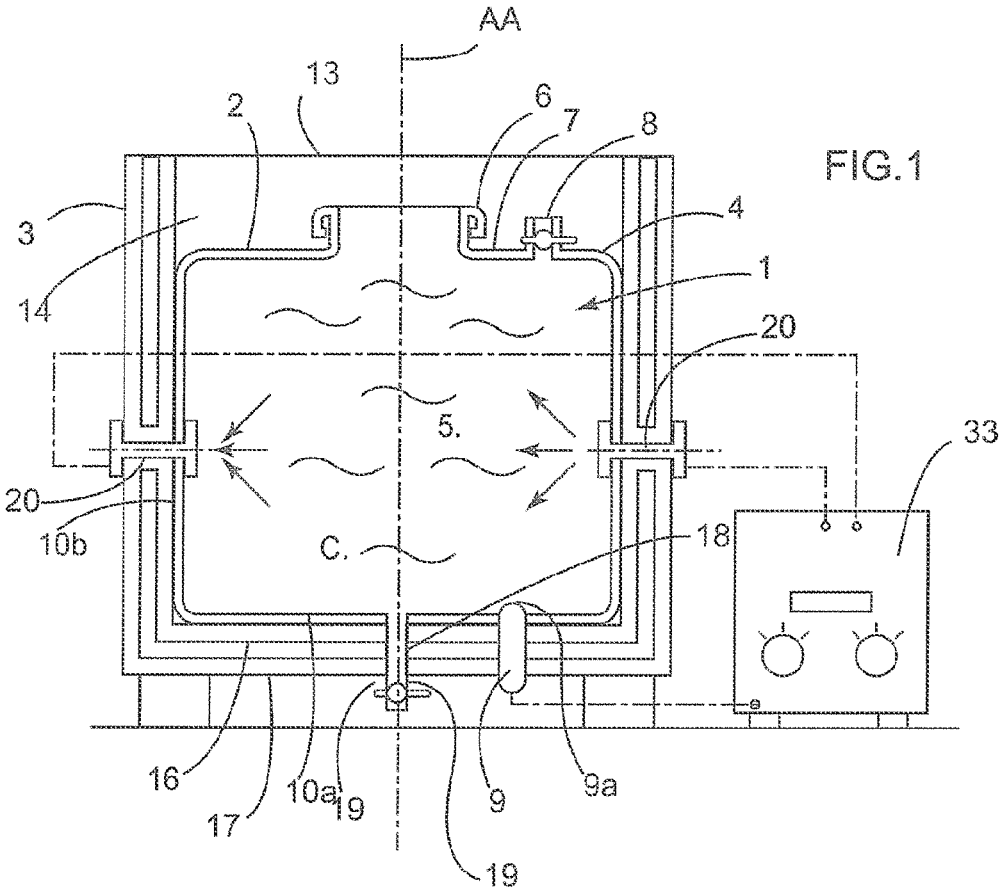
FIG.1
FIG.2a
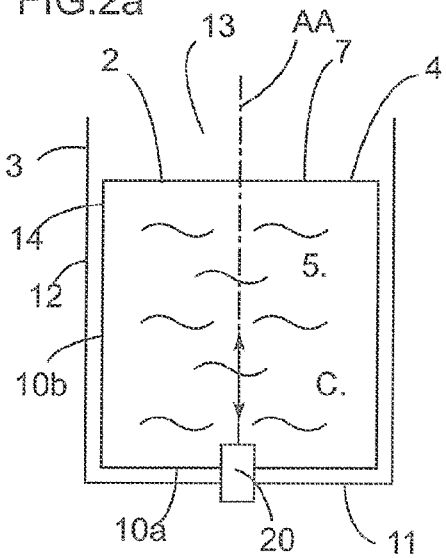
FIG.2b
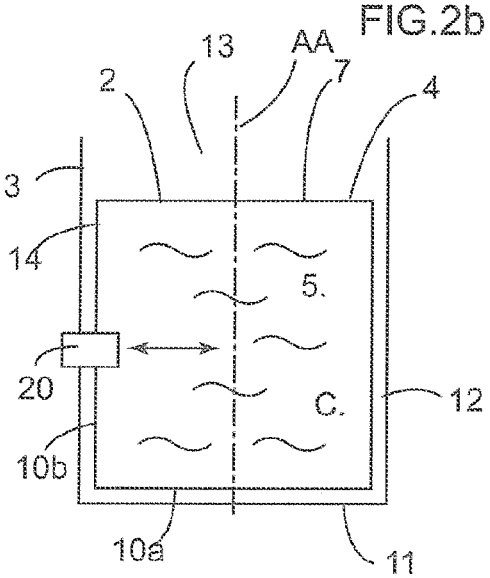

MIXING OF THE CONTENT OF A FLEXIBLE CONTAINER FOR BIOPHARMACEUTICAL USE

FIELD OF THE INVENTION

The invention relates to mixing the content of a flexible container for biopharmaceutical use.

It more specifically concerns a receptacle for biopharmaceutical use, a rigid assembly for receiving and retaining the flexible container of such a receptacle for biopharmaceutical use, and, lastly, a method for making use of such a receptacle for biopharmaceutical use.

BACKGROUND OF THE INVENTION

It is known in the biopharmaceutical field to provide and make use of receptacles able to receive a biopharmaceutical product that is generally liquid or pasty at least when it is to be mixed, as its content. Such receptacles are typically intended for the preparation of a biopharmaceutical product, for storage, for transport, or for carrying out a specific process that is physical, chemical, or biological in nature, for example a freezing/thawing process.

"Biopharmaceutical product" is understood here to mean a product obtained from biotechnology (culture media, cell cultures, buffer solutions, artificial nutrition liquids), or a pharmaceutical product, or more generally a product intended for use in the medical field.

Such a receptacle for biopharmaceutical use firstly comprises a flexible container having a flexible wall delimiting at the front an inside space for receiving the biopharmaceutical product. Such a flexible container or bag is disposable, closed, sealed, sterile, and of plastic material such as polyethylene or a complex including polyethylene. Such a container comprises means for introducing into and means for extracting from the inside space the biopharmaceutical product or components of the product, it being possible to place these means, depending on the moment and on requirements, in the open or closed state.

There are known bags of this type in which the two large walls are directly joined to each other. Once expanded, such bags have a limited volume and remain relatively thin, which is why they are often referred to as "pillow bags" or "2D bags" (where D stands for dimensional). Also known are 3D bags which have two large walls connected by and welded to two side gussets, which can be folded flat or unfolded when deployed, the volume then reaching at least 50 liters and up to 3000 liters or more. Such 3D bags are described in document WO00/04131a or sold under the trademark FLEXEL® 3D.

Such a receptacle for biopharmaceutical use secondly comprises mixing means which mix the content of the inside space. These mixing means are adjacent to a defined local part of the flexible wall, for example but not limited to the bottom wall or the top wall. These mixing means include movable displacement means, which are adjoining the inside space and are able to displace the content within it.

Such a receptacle for biopharmaceutical use comprises, thirdly, means for driving the movable displacement means, and fourthly, rigid and leaktight connection means ensuring a rigid and leaktight connection between the mixing means and the given part of the flexible wall.

The prior art is illustrated in particular by patents WO 02/062458, WO 03/028869, WO 2006/002091, WO 2006/0630a87 and WO 2009/143925.

In the known embodiments, the movable displacement means of the mixing means are typically a propeller rotatably mounted within the inside space itself. As a result, these known embodiments have the disadvantages inherent in the presence within the inside space of movable displacement means such as a rotating fan. These disadvantages include the space required and the risk of damaging the flexible wall. Another disadvantage arises when the mixture concerns a content that is to undergo a freezing/thawing sequence, because such mixing means cannot be caught within the solidified content.

The invention aims to provide a solution to these disadvantages by proposing mixing means based on a completely different concept.

There are known studies which seek to apply the water-jet propulsion process of squids and jellyfish to industry. This involves generating a jet stream which can be efficiently used to set an adjacent fluid in motion. To achieve this, a casing is provided which defines an inside chamber and has an opening. A flexible membrane is mounted in the casing and, by its movements, it modifies the volume of the chamber. Eddies are thus ejected from the chamber through the opening. U.S. Pat. No. 5,894,990, U.S. Pat. No. 6,123,145, U.S. Pat. No. 6,457,654, U.S. Pat. No. 5,988,522, U.S. Pat. No. 6,056,204, U.S. Pat. No. 5,957,413 and U.S. Pat. No. 5,758,823 refer to this technology. This technology has been suggested for various applications, such as motors and aeronautics, but not in the field of receptacles for biopharmaceutical use in which the flexible container has a flexible wall. The existence of such a flexible wall further discourages the application of this technology in this field, because the flexible wall does not allow setting the mixing means in motion.

The invention aims to solve these problems.

OBJECT AND SUMMARY OF THE INVENTION

For this purpose, the object of a first aspect of the invention is a receptacle for biopharmaceutical use comprising:

- a flexible container having a flexible wall delimiting at the front an inside space able to receive content that is a biopharmaceutical product which is generally liquid or pasty at least when it is to be mixed,
- mixing means able to mix the content of the inside space, adjacent to a given part of the flexible wall, including movable displacement means adjoining the inside space and able to displace the content,
- means for driving the movable displacement means,
- and rigid and leaktight connection means ensuring a rigid and leaktight connection between the mixing means and the given part of the flexible wall.

This receptacle for biopharmaceutical use is such that:

the mixing means comprise:

- an axial guiding and peripheral closure sleeve which is rigid with a constant transverse cross-section along its axis, having towards its front part a suction-discharge opening adjoining the inside space,
  - a suction-discharge part which is unpierced and arranged transversely in the sleeve in a leaktight manner, and of which at least one movable part is mounted to slide alternately forwards and backwards axially,
  - a suction-discharge cavity, delimited by the lateral inside face of the sleeve and the front inside face of the suction-discharge part, in communication with the inside space via the suction-discharge opening, the drive means are able to drive the movable part of the suction-discharge part and assure its movement in at least one sequence of sliding alternately forwards and backwards axially such that the volume of the suction-discharge cavity has at least one sequence of alternately compressing and expanding, and thus the content of the flexible container adjacent to the suction-discharge opening is moved about and the content of the flexible container is mixed, immobilization means ensure the relative immobilization of the axial guiding and peripheral closure sleeve and of the given part of the flexible wall, including during the sliding axial movement of the movable portion of the suction-discharge part.

In a first embodiment, the given part of the flexible wall comprises a through-hole with which the mixing means are axially associated, and the rigid and leaktight connection means are secured in a leaktight manner on the one hand to the sleeve by a side part peripheral and external to the sleeve, and on the other hand to the given part of the flexible wall by a peripheral portion around the mounting hole and lying flat on the flexible wall.

In a first variant, the hole in the given part of the flexible wall allows the passage of the sleeve, and the suction-discharge opening is axially substantially adjacent to the flexible wall, with the mixing means extending axially substantially rearwards from the given part of the flexible wall.

In a second variant, the hole in the given part of the flexible wall provides the communication between the suction-discharge cavity and the inside space, and the suction-discharge opening is axially offset rearwards from the given part of the flexible wall, with the mixing means extending axially substantially rearwards from the given part of the flexible wall.

In a third variant, the hole in the given part of the flexible wall allows the passage of the sleeve, and the suction-discharge opening is axially offset frontwards from the given part of the flexible wall, with the mixing means extending axially either partially frontwards and partially rearwards or substantially frontwards from the given part of the flexible wall.

In a second embodiment, the given part of the flexible wall is unpierced; the rigid and leaktight connection means are secured in a leaktight manner on the one hand to the sleeve by a part external to the sleeve and on the other hand to the given part of the flexible wall by a part lying flat on the flexible wall; and the mixing means extend axially substantially frontwards from the given part of the flexible wall.

In one embodiment, the rigid and leaktight connection means comprise a transverse face adjoining the sleeve, rigidly secured, to lie flat, in a leaktight manner, to the flexible wall at or near the given part. In particular, said transverse face is part of a rigid wall, and more specifically is rigidly secured, to lie flat, in a leaktight manner to the flexible wall, by welding or adhesive bonding.

In one embodiment, the axial guiding and peripheral closure sleeve comprises a front part laterally delimited by the lateral inside face of the sleeve, delimited at the back by the front inside face of the suction-discharge part in the extreme rearward sliding position, and delimited at the front by the suction-discharge opening. In one embodiment, the sleeve comprises a rear part laterally delimited by the lateral inside face of the sleeve and delimited at the front by the rear face of the suction-discharge part in the extreme rearward sliding position. In one embodiment, the sleeve comprises a rear part delimited at the back by a transverse terminal rear wall.

In a first embodiment, the suction-discharge part is a rigid piston mounted in the sleeve. In a second embodiment, the suction-discharge part is a deformable membrane having a fixed peripheral part attached to the lateral inside face of the sleeve and a central movable part.

In one embodiment, the suction-discharge part is mounted to slide axially between an extreme rearward position and an extreme forward position, respectively the furthest from and the closest to the suction-discharge opening. In particular, in its extreme forward position, the suction-discharge part closes off the suction-discharge opening.

In one embodiment, the suction-discharge cavity is transversely flattened, its size in the transverse direction being larger than its size in the axial direction.

In some embodiments, the suction-discharge opening is formed either by a single opening able to shape a single flow or by a plurality of basic openings able to shape a plurality of basic flows. In the latter case, in some possible implementations, several basic openings are associated with a single suction-discharge cavity, or a given basic opening is associated with a given basic suction-discharge cavity, and/or several basic openings are placed side by side in the transverse direction and/or are spaced apart in the axial direction and/or the axes of several basic openings are either parallel to each other or are angled relative to each other.

In one embodiment, the suction-discharge opening comprises a peripheral edge which extends either in an axial direction or in a direction that is angled relative to the axis, able to form a flow which extends either in the axial direction or in a direction that is angled relative to the axis.

In one embodiment, a suction-discharge opening is associated with flow orientation means and/or shaping means and/or concentration means and/or spreading means, able to orient and/or shape and/or concentrate and/or spread out the flow.

In a first embodiment, the drive means comprise means for driving an axial movement in one direction combined with means for axial return in the opposite direction. For example, the means for driving an axial movement in a direction are electromechanical or electromagnetic means and the means for axial return in a direction are elastic means such as a spring. In one embodiment, a movable plunger core is provided, arranged transversely in the sleeve behind the suction-discharge part and mounted to slide alternately forwards and backwards axially, and an axially sliding connection member connecting the movable plunger core and the suction-discharge part, with the means for driving an axial movement and the means for axial return acting on the movable plunger core.

In a second embodiment, the drive means comprise means for driving an axial movement in the two opposing directions, for example pneumatic means.

In some embodiments, the drive means extend axially substantially behind the given part of the flexible wall, extend axially substantially behind the suction-discharge part, and are located externally to the inside space where the content can be found.

In a first embodiment, a drive means unit is associated with a suction-discharge part unit and/or suction-discharge cavity unit. In a second embodiment, a drive means unit is associated with several suction-discharge part units and/or suction-discharge cavity units.

In one embodiment, the immobilization means comprise, on the one hand, an application face rigidly adjoining the sleeve and an abutting face of a supporting part, the given part of the flexible wall and the abutting face of the supporting part having a fixed relative position, and on the other hand, fixed and rigid retention means for retaining said application face applied in a fixed and rigid manner to said abutting face. In particular, and depending on the case, said means for fixedly and rigidly retaining said application face applied in a fixed and rigid manner to said abutting face are arranged in a detachable or a non-detachable manner, the mixing means being mounted on the flexible container in a manner that is respectively removable or permanent.

In a variant execution, the fixed and rigid retention means for retaining said application face applied in a fixed and rigid manner to said abutting face comprise a clamping member rigidly adjoining the sleeve which cooperates, in clamping, with a complementary clamping member of an immobilization part having a second application face applied to and retained in a fixed and rigid manner on a second abutting face of a second supporting part, the given part of the flexible wall and the second abutting face of the second supporting part having a fixed relative position. For example, the immobilization means comprise the first application face rigidly adjoining the sleeve and the first abutting face of the first supporting part and the second application face and the second abutting face of the second supporting part, the first application face and the second application face being arranged transversely and oriented in two opposite axial directions, the first abutting face and the second abutting face being arranged transversely and oriented in two opposite axial directions. For example, the first application face rigidly adjoining the sleeve is a transverse shoulder of the peripheral lateral outside face of the sleeve, oriented towards the rear, the sleeve having a front part of greater external transverse size and a rear part of smaller external transverse size. For example, the immobilization part is a nut and the clamping member is a complementary screw thread of a clamping member adjoining the sleeve being a screw thread. For example, the first supporting part is a first rigid wall and the second supporting part is a second rigid wall, the first rigid wall and the second rigid wall being arranged substantially parallel to each other and comprising two facing through-holes to allow the passage of the sleeve. For example, the first rigid wall and/or the second rigid wall comprise a cavity for respectively housing the front part and/or the rear part of the sleeve. For example, the mixing means and the immobilization means are substantially between the two free opposing faces, respectively in front of the first rigid wall and behind the second rigid wall. For example, the first supporting part and the second supporting part are parts of a same rigid assembly for receiving and retaining the flexible container, comprising a bottom wall and a side wall, within which is received and externally retained the flexible container whose flexible wall is able to press against the inside face of the bottom wall and of the side wall. Where necessary, said means of fixedly and rigidly retaining said application face applied in a fixed and rigid manner to said abutting face are adhesive bonding means or welding means.

In another variant execution, the application face is the rear face of a transverse shoulder at the end of the sleeve, the abutting face is the front face of a supporting part, the fixed and rigid retention means for retaining said application face applied in a fixed and rigid manner against said abutting face are mutual clamping means, with the supporting part being part of a rigid receiving and retention assembly of a freezing/thawing system. In this variant, the supporting part and the rigid receiving and retention assembly of the freezing/thawing system comprises two walls pressing against one another within the area of the application face and spaced apart from one another in one or more area distanced from the area of the application face in order to leave a free space suitable for accommodating a heat transfer means. In addition, the supporting part of the rigid receiving and retention assembly of the freezing/thawing system comprises a passage to allow the passage of the drive means.

In one embodiment, the container for biopharmaceutical use additionally comprises control means for controlling—starting, stopping, speed, frequency, displacement—the drive means of the movable displacement means. And, where necessary, it additionally comprises means which respond to a control parameter of the control means, to which the control means are responsively coupled. For example, if in its extreme forward position the suction-discharge part closes off the suction-discharge opening, the control means control the drive means of the movable displacement means so that when finished functioning, the suction-discharge part is in its extreme forward position where it closes off the suction-discharge opening.

In the embodiments, a mixing means unit is located either on the bottom part or on the side part or on the top part of the flexible wall of the flexible container.

In the embodiments, the receptacle for biopharmaceutical use comprises a single mixing means unit or comprises a plurality of mixing means units. In the latter case, in one embodiment, the locations—coaxially opposite or offset or angled—on the flexible wall of the flexible container of the plurality of mixing means units and the programming of their control means—phase synchronized or in phase opposition or non-synchronized—are chosen so that the mixing means units operate in synergy.

In one development, the invention also relates to a receptacle for biopharmaceutical use which additionally comprises aeration means able to deliver aeration gas to the content, comprising aeration gas supply means having at least one tubular element extending in a fluid communication from outside the flexible container to the aeration gas distribution means located within the inside space of the flexible container and rigidly supported by a part forming a fixed peripheral support which is part of the mixing means or of the rigid and leaktight connection means. In particular, the aeration gas distribution means are arranged at the periphery of the mixing means or of the rigid and leaktight connection means, in an adjoining manner or at a distance away.

In another development, the invention also relates to a receptacle for biopharmaceutical use which additionally comprises means for collecting a sample of the content of the inside space, opening into the suction-discharge cavity.

In one characteristic, the receptacle constitutes a mixing vessel or a bioreactor or a freezing/thawing vessel.

In a second aspect, the object of the invention is a rigid receiving and retention assembly for receiving and retaining the flexible container of a receptacle for biopharmaceutical use as described above, comprising a bottom wall and a side wall, within which is received and externally retained the flexible container whose flexible wall is able to press against the inside face of the bottom wall and of the side wall, said inside face forming, facing the mixing means of a receptacle, an abutting face which is part of the immobilization means of the mixing means.

In one embodiment, the flexible wall of the flexible container is able to press against the inside face of the bottom wall and of the side wall, said inside face forming, facing the mixing means of a receptacle, an abutting face which is part of the immobilization means of the mixing means.

In one embodiment, the rigid assembly for receiving and retaining the flexible container of such a receptacle for biopharmaceutical use comprises two rigid walls arranged substantially parallel to one another and two facing through-holes to allow the passage of the sleeve of the mixing means. In one characteristic, one and/or the other of the two rigid walls comprises a cavity for respectively housing the front part and/or the rear part of the sleeve of the mixing means.

In a third aspect, the object of the invention is a method for making use of a receptacle for biopharmaceutical use as described above, in which:

- a receptacle for biopharmaceutical use as described above is provided,
- biopharmaceutical product is provided which is generally liquid or pasty at least when it is to be mixed, or one or more components of such a product,
- the inside space of the flexible container is filled with the biopharmaceutical product or with one or multiple components, thus forming the content of the flexible container, the suction-discharge cavity, in communication with the inside space, being filled with said content,
- when the content of the flexible container is to be mixed, the drive means are used such that:
  - the movable part of the suction-discharge part is displaced in at least one sequence of axially sliding alternately forwards and backwards,
  - the volume of the suction-discharge cavity follows at least one sequence of alternately compressing and expanding, and, in alternation, the content located in the suction-discharge cavity is discharged into the inside space through the suction-discharge opening and the content of the inside space is sucked into the cavity through the suction-discharge opening,
  - the content of the flexible container adjacent to the suction-discharge opening is displaced,
  - and in this manner the content of the flexible container is mixed.

In one embodiment, a series of sequences of sliding the suction-discharge part alternately forward and backward axially and a series of alternating sequences of compression and expansion of the volume of the suction-discharge cavity are carried out.

In one embodiment, when stopping the use of the drive means, the suction-discharge part is brought to its extreme forward position where it closes off the suction-discharge opening.

In one embodiment, the method comprises at least one additional step in which the inside space of the flexible container is filled with biopharmaceutical product or with one or more components.

In one embodiment, the drive means are controlled—starting, stopping, speed, frequency, displacement—as a function of a control parameter, such as time or the degree of homogeneity/heterogeneity of the content of the flexible container.

In one embodiment, where immobilization means ensure the relative immobilization of the axial guiding and peripheral closure sleeve and of the given part of the flexible wall, including during the axial sliding motion of the movable part of the suction-discharge part:

- a rigid assembly for receiving and retaining the flexible container of a receptacle for biopharmaceutical use as described above is additionally provided,
- and said flexible container is placed in said rigid receiving and retention assembly.

In one characteristic, the receptacle is used as a mixing vessel or as a bioreactor or as a freezing/thawing vessel.

BRIEF DESCRIPTION OF THE DRAWINGS

Several embodiments of the invention will now be described with the aid of the drawings, in which:

FIG. 1 is a schematic cross-sectional view in a vertical median plane of a receptacle for biopharmaceutical use according to the invention, in which the container is flexible, filled with content which is a generally liquid or pasty biopharmaceutical product, is received and externally retained in a rigid receiving and retention assembly, the receptacle here being equipped with two mixing means units arranged face to face, with associated immobilization means on the two vertical walls opposite the rigid receiving and retaining assembly; drive means, rigid connection means, control means, and means responsive to a control parameter are associated with the mixing means.

FIGS. 2A, 2B, 2C, 2D, 2E and 2F are six simplified schematic views analogous to the schematic view in FIG. 1, illustrating different variant arrangements of a mixing means unit on a flexible container: a single unit arranged perpendicularly in the lower part and acting upwards (FIG. 2A), a single unit placed perpendicularly on the side and acting in a generally horizontal direction (FIG. 2B), a single unit arranged perpendicularly in the upper part and acting downwards (FIG. 2C), two units arranged perpendicularly on a same side, in this case the lower part and acting upwards (FIG. 2D), three units arranged two on one side and one on the opposite side and acting in a generally horizontal direction (FIG. 2E), four units placed two on one side and two on the opposite site, angled relative to the perpendicular in the given part adjoining the flexible wall of the flexible container and acting at an angle (FIG. 2F).

MORE DETAILED DESCRIPTION

Figure 2C:
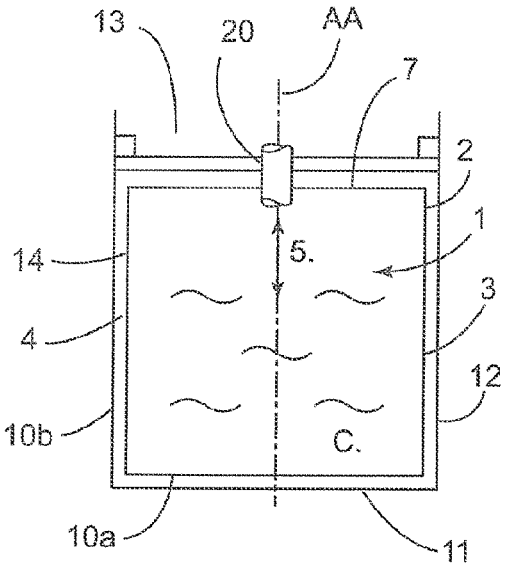

We will now refer specifically to FIG. 1, which illustrates a receptacle for biopharmaceutical use 1 having a flexible container 2, filled with content C, namely a generally liquid or pasty biopharmaceutical product, received and externally retained in a rigid receiving and retention assembly 3. Either the content is always liquid or pasty or it is only at a particular moment or period. For example, the content C may be in a solid state following a freezing operation or in a fluid state when it is thawed.

"Biopharmaceutical product" is understood here to mean a product originating from biotechnology (culture media, cell cultures, buffer solutions, artificial nutrition liquids), or a pharmaceutical product, or more generally a product intended for use in the medical field. The biopharmaceutical product is generally liquid or pasty, at least when it is to be mixed, so as to allow such mixing. It may only have one fluid phase or may have multiple fluid phases, including products that are originally solid or have a certain consistency that are to be mixed in a fluid medium.

Such a receptacle 1 is typically intended for preparing a biopharmaceutical product, for storage, for transport, or for performing a specific process that is physical, chemical, or biological in nature such as mixing, or a bioreactor or a freezing/thawing system.

The flexible container 2 comprises a flexible wall 4 which delimits an inside space 5 able to receive the content and here having actually received it.

By convention, "forward" and "front" are understood to refer to that which is closest to the flexible wall 4 or facing towards the inside space 5, and "backward", "back", and "rear" refer to that which is furthest away from the flexible wall 4 or facing away from the inside space 5.

Such a container 2 is typically a 3D bag which comprises two large walls connected by and welded to two side gussets, which may be folded flat (such as for storage and transport) or unfolded and deployed (for filling with content), the volume of the inside space 5 being at least 50 liters and up to 3000 liters or more. Such 3D bags are described in patent WO00/04131a or sold under the trademark FLEXEL® 3D. It is understood that this bag embodiment is provided purely as an example, as the flexible container can be implemented differently. In principle, the arrangement and implementation of such a flexible container 2 are part of the general knowledge of a person skilled in the art or are within his reach. In all cases, the container 2 has a certain flexibility, being made of a film of plastic material having a certain flexibility, of a single layer or most often of multiple layers. It is in order to assure the external retention of such a flexible container 2 once it is filled with content C, that it is placed and externally retained in the rigid receiving and retention assembly.

The flexible container 2 is most often equipped with ports, such as, for example, a port 6 for the entry or introduction of a product to be mixed with the content of the container 2, located in the upper part 7 of the flexible container 2, a port 8 for supplying an aeration gas (sparging), a port 9 which allows mounting a functional member or measurement means 9*a*, for example for measuring a parameter reflecting or related to the homogeneity, heterogeneity, or blending of the content in the inside space 5. For example, such measurement means 9*a* are light-sensitive and measure the transparency or opacity or homogeneity or heterogeneity of the content in the flexible container 2 or the content mixing time. The principles of the arrangement of such ports 6, 8, 9 are part of the general knowledge of a person skilled in the art or are within his reach.

The flexible container 2, once filled and in place, has a lower part 10*a*, arranged horizontally, a side part 10*b*, arranged vertically, and the upper part 7, also arranged horizontally. It also has a main axis AA which is substantially vertical, which the qualifiers "top", "bottom", "upper", "lower", "side", "horizontal", and "vertical" are understood as being relative to for the flexible container in general.

The rigid receiving and retention assembly 3 typically comprises, in this context, a lower bottom wall 11, arranged horizontally, and a side wall 12, arranged vertically, and an opening 13 in the upper part to allow placing and removing the flexible container 2. The rigid receiving and retention assembly 2 delimits an inside space 14 accessible through the opening 13. The flexible container 2 is received and externally retained within this space 14, where the lower portion 10*a* and upper portion 10*b* of the container's flexible wall 4 press against the inside face of the bottom wall 11 and of the side wall 12. In addition, the rigid receiving and retention assembly 3 is usually equipped with holes 15 which cooperate with the ports of the flexible container 2. Where necessary, the rigid receiving and retention assembly 3 also comprises restraining means able to come press against the upper part 7 of the flexible container 2.

In one embodiment, the bottom wall 11, the side wall 12, and where applicable the upper restraining wall of the rigid receiving and retention assembly 3, are each composed of two rigid walls arranged substantially parallel to each other, the internal one 16 towards the front and the external one 17 towards the back. In this case, each hole 15 consists of two holes arranged substantially parallel to each other, the internal one 18 towards the front and the external one 19 towards the back.

In principle, the arrangement and implementation of such a rigid receiving and retention assembly 3 are part of the general knowledge of a person skilled in the art or are within his reach. In all cases, the rigid receiving and retention assembly 3 is rigid and constitutes a fixed and non-deformable part which supports the flexible container 2. Of course, the rigid receiving and retention assembly 3 can be transported, and possibly disassembled or folded.

As indicated, the content of the receptacle 1 is to be mixed within the context of its preparation, its storage, its transport, or the execution of a specific process that is physical, chemical, or biological in nature such as mixing or a bioreaction or a freezing/thawing sequence. The purpose of this mixing can be to obtain a certain degree of homogeneity either of the components or of the phases of the content when it has several or of the content itself, for example typically during a freezing-thawing sequence. This mixing is to be understood as having the usual meaning in the biopharmaceutical field. It is based on an agitation of the content of the flexible container 2.

For this purpose, the container 1 comprises what we will refer to in general as the mixing means 20. These mixing means are able to mix the content in the inside space 5. These mixing means 20, as a whole, are adjacent to a given part 21 of the flexible wall 4, which thus contributes to retaining the mixing means 20. Rigid and leaktight connection means 22 ensure a rigid and leaktight connection between the mixing means 20 as a whole and the given part 21 of the flexible wall 4. "Rigid connection" is understood to mean the fact that with the means 22, no relative general movement is possible between the mixing means 20 as a whole and the given part 21 of the flexible wall 4. The connection between them is therefore fixed.

The mixing means 20 also include movable displacement means, adjoining the inside space 5 and able to displace the content by acting on it. Drive means 23 are associated with these movable displacement means.

In the context of the invention, the mixing means 20 firstly comprise an axial guiding sleeve 24, of axis BB, and with peripheral closure. This sleeve 24 is rigid and has a constant transverse cross-section along its axis BB, for example a circular cross-section. This sleeve comprises a front part 25 ("front" being understood to be that which, relative to the flexible wall 4, is closest to or facing the inside space 5), near which is located a suction-discharge opening 26 adjoining the inside space 5, and a rear part 27 ("rear" being understood to be that which, relative to the flexible wall 4, is the furthest or facing away from the inside space 5).

The mixing means 20 next comprise a suction-discharge part 28 which is solid, arranged transversely relative to the axis BB in the sleeve 24, and leaktight. This suction-discharge part 28 has at least one movable part 28*a* mounted to slide alternately forwards and backwards axially, said movable part constituting the previously mentioned movable displacement means comprised in the mixing means 20 and associated with the drive means 23.

In the description of such a mixing means unit 20, the term "axial" refers to axis BB of the mixing means 20. It is also in reference to axis BB that the terms "peripheral" and "lateral" are to be understood.

The mixing means 20 next comprise a suction-discharge cavity 29, delimited by the lateral inside face 30*a* of the sleeve 24 and the front inside face 31*a* of the suction-discharge part 28. This suction-discharge cavity 29 communicates with the inside space 5 through the suction-discharge opening 26, which is open.

The expression "suction-discharge" expresses the functional process that is the basis of the mixing. It involves, in one and generally multiple sequences, the suction and discharge of the content of the inside space 5, by means of the suction-discharge cavity 29, the suction-discharge part 28 which cooperates with it, and the suction-discharge opening 26 which provides the communication between the inside space 5 and the suction-discharge cavity 29.

In fact, the drive means 23 are able to drive the movable part 28*a* of the suction-discharge part 28 by causing its movement in at least one, and generally multiple, sequence (s) of sliding alternately forwards and backwards axially.

Thus the volume of the suction-discharge cavity 29 undergoes at least one, and generally multiple, alternating sequence(s) of compression and expansion. And thus the content of the flexible container 2 adjacent to the suction-discharge opening 26 is displaced. In this manner the content of the flexible container is mixed.

The receptacle 1 also comprises immobilization means 32 which ensure the relative immobilization of the axial guiding and peripheral closure sleeve 24 and of the given part 21 of the flexible wall 4, including during the axial sliding movement of the movable part 28*a* of the aspiration/suction part 28.

The presence of the immobilization means 32 allows the drive means 23 acting on the movable part 28*a* of the suction-discharge part 28 to assure an effective axial relative forward/backward displacement of the movable part 28*a* of the suction-discharge part 28 relative to the sleeve 24, while a rigid connection is established between the mixing means 20 as a whole and the given part 21 of the flexible wall 4 which is deformable and subjected to the forces from the drive means 23.

In a preferred manner, the axis BB is arranged perpendicularly to the given part 21, as illustrated in FIGS. 2A to 2E. However, it is possible for the axis BB to be arranged at an angle to the perpendicular to the given part 21, as illustrated in FIG. 2F.

The receptacle 1 also comprises control means 33 for controlling the stopping, starting, speed, frequency, displacement, of the drive means 23 for the movable part 28 of the suction-discharge part 28 forming the movable means for displacing the content of the flexible container 2. Thus one can combine a high or low or intermediate amplitude of motion with a high or low or intermediate speed, with or without stop time, as needed. These control means 33, which are electrical or electronic, programmable or including a programmable logic controller, can be housed in a shell arranged outside the receptacle 1. They may be responsively coupled to means 9*a* which respond to a control parameter such as the transparency or opacity or homogeneity or heterogeneity of the content of the flexible container 2 or the content mixing time.

We will now refer to FIGS. 2A to 2F, which illustrate different arrangements of mixing means 20 on a receptacle 1. These different arrangements are provided as examples and are in no way limiting.

Figure 2D:
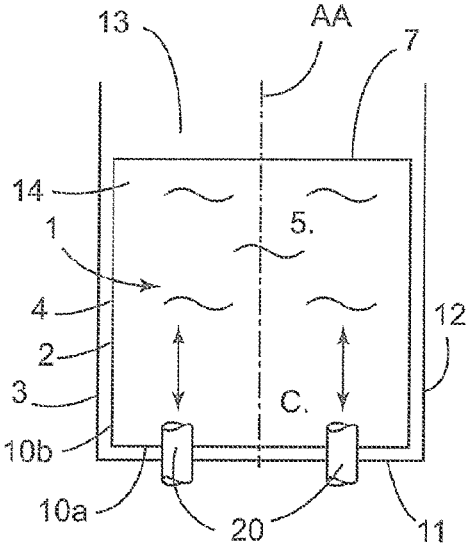
Figure 2E:
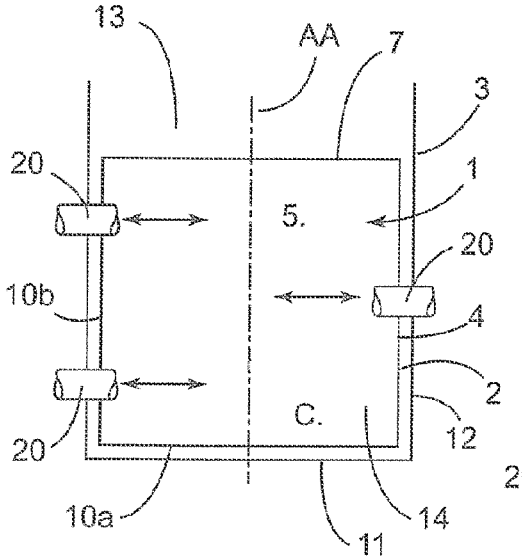
Figure 2F:
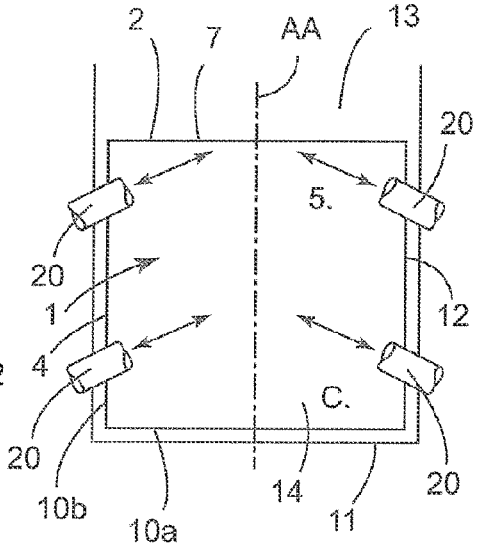
Figure 3:
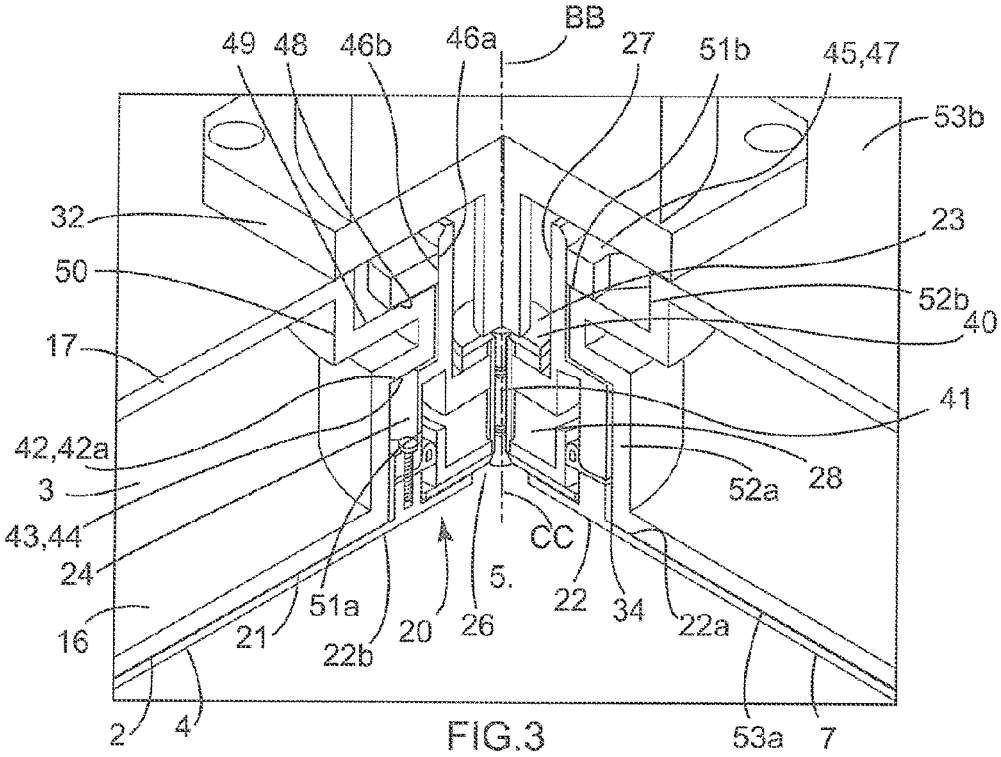
FIG. 3 is a partial perspective cutaway view illustrating one possible embodiment, where the flexible container is in place within a rigid receiving and retention assembly with two walls having two openings at the front and back, the flexible wall of the flexible container having a through-hole associated with the mixing means arranged at the top and acting downwards, of which the suction-discharge part, in this case a piston, is represented in the extreme forward position where it closes off the suction-discharge opening located in the extension of the flexible wall of the flexible container, the drive means comprising means for driving axial movement combined with return means, with only one suction-discharge opening in this case.
Figure 4:
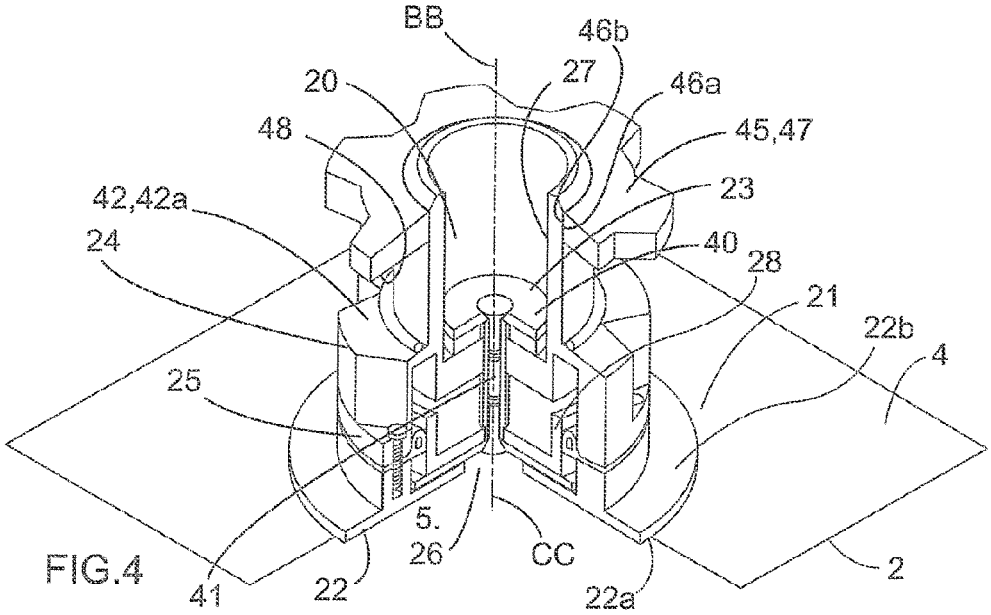
FIG. 4 is a view analogous to FIG. 3 but with the rigid receiving and retention assembly removed, showing the association of the flexible wall of the flexible container and the mixing means.

In one possible arrangement, the receptacle 1 comprises a single mixing means unit 20 (FIGS. 2A to 2C). In other arrangements, it comprises a plurality of mixing means units 20 (FIGS. 2D to 2F).

Depending on the arrangements, a mixing means unit 20 is located either (FIG. 2A) on the lower or bottom part 10*a*, 11 (respectively the flexible container 2 and the rigid receiving and retention assembly 3), or (FIG. 2B) on the side part 10*b*, 12, or (FIG. 2C) on the top upper part 7 of the flexible wall 4 of the flexible container which is associated with restraining means such as a plate, forming part of the rigid receiving and retention assembly 3.

Depending on the arrangements, a mixing means unit 20 acts upwards (FIG. 2A), or acts laterally in a generally horizontal direction (FIG. 2B), or acts downwards (FIG. 2C).

Depending on the arrangements, the axis BB of a mixing unit 20 is perpendicular to the given part 21 of the flexible wall 4 (FIGS. 2A to 2E), or is angled relative to the perpendicular to the given part 21 (FIG. 2F).

When a plurality of mixing means units 20 are provided, their locations on the flexible container 2 as well as the programming of their control means 38 are chosen so that the mixing means units 20 operate in synergy and not in opposition to one another. The choice of such locations and such programming are part of the general knowledge of a person skilled in the art or are within his reach. For the locations, these may be coaxially facing or be off-centered (FIG. 2E) or angled (FIG. 2F) or parallel to each other (FIG. 2D). For the programming of the control means 32, this in particular may be phase synchronized or in phase opposition or not synchronized.

Two families of embodiments can be defined concerning the structure of the flexible wall 4 in the area of the predetermined part 21 and its arrangement with the mixing means 20 and the rigid and leaktight connection means 22.

In the first family of embodiments, in a typical representation as shown in FIGS. 3 to 16 and 18 to 20, the given part 21 of the flexible wall 4 contains a through-hole 34 with which the mixing means 20 are axially associated. In this case, the rigid and leaktight connection means 22 are solidly attached in a leaktight manner, on the one hand, to the sleeve 24 by a side part 35*a* peripheral and external to the sleeve 24, and on the other hand, to the given part 21 of the flexible wall 4 by a peripheral part 35*b* around the assembly hole and flat on the flexible wall 4. These two parts, side part 35*a* and peripheral part 35*b*, can have numerous configurations, each adapted to the arrangement of the predetermined part 21 of the flexible wall 4 with the mixing means 20 and the rigid and leaktight connection means 22.

In one possible configuration illustrated in FIGS. 3 to 11, the hole 34 in the given part 21 of the flexible wall 4 allows the passage of the sleeve 24, and the suction-discharge opening 26 is substantially adjacent axially (relative to the axis BB) to the flexible wall 4, meaning that it is located within the envelope of the wall 4. With such a configuration, the mixing means 20 extend axially substantially behind the given part 21 of the flexible wall 4.

Figure 15:
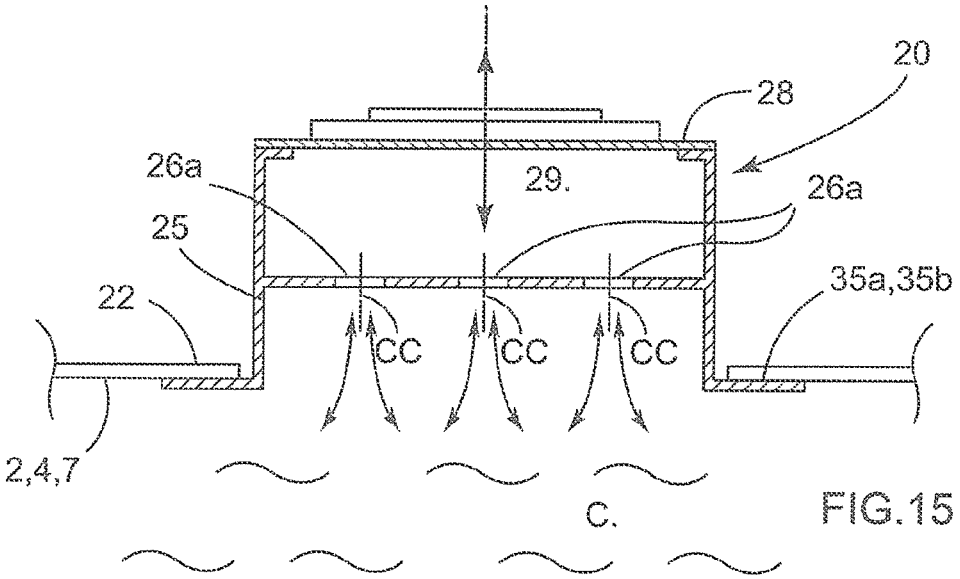

In another possible configuration illustrated in FIG. 15, the hole 34 in the given part 21 of the flexible wall 4 establishes the communication between the suction-discharge cavity 29 and the inside space 5, and the suction-discharge opening 26 is axially distanced rearwards relative to the given part 21 of the flexible wall 4. With such a configuration, the mixing means 20 extend axially substantially behind the given part 21 of the flexible wall 4. With such a configuration, there can be considered to be two suction-discharge openings, one at the rear, consisting of the suction-discharge opening 26, and the other at the front, consisting of the hole 34.

Figure 14:
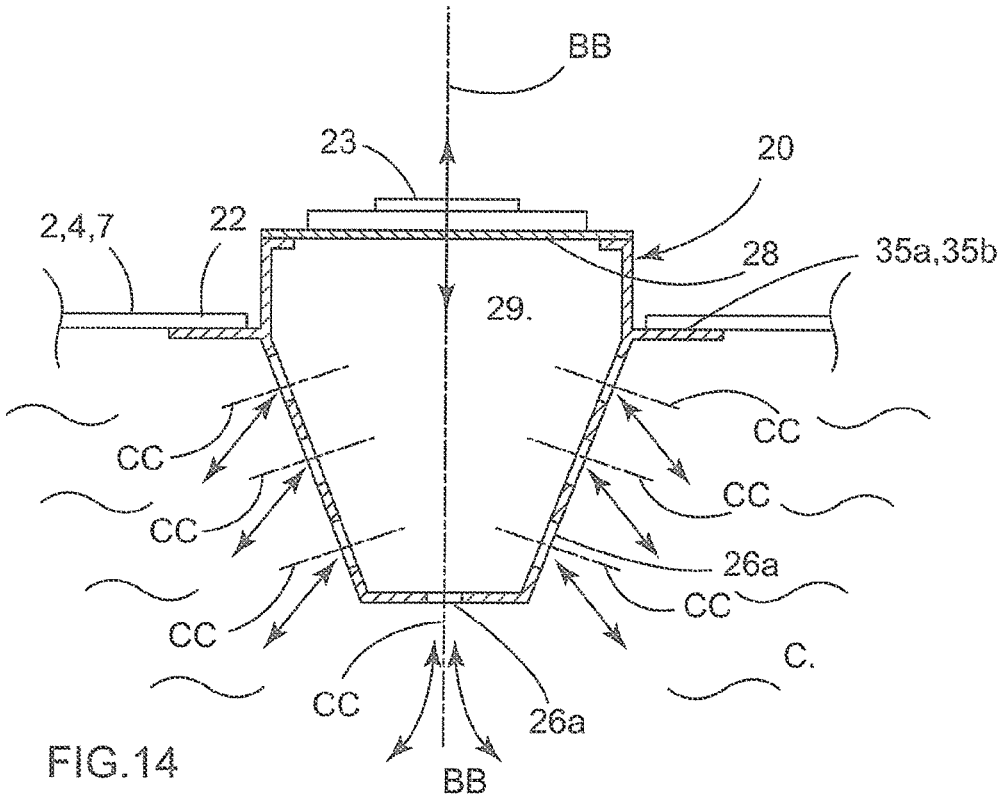
Figure 19:
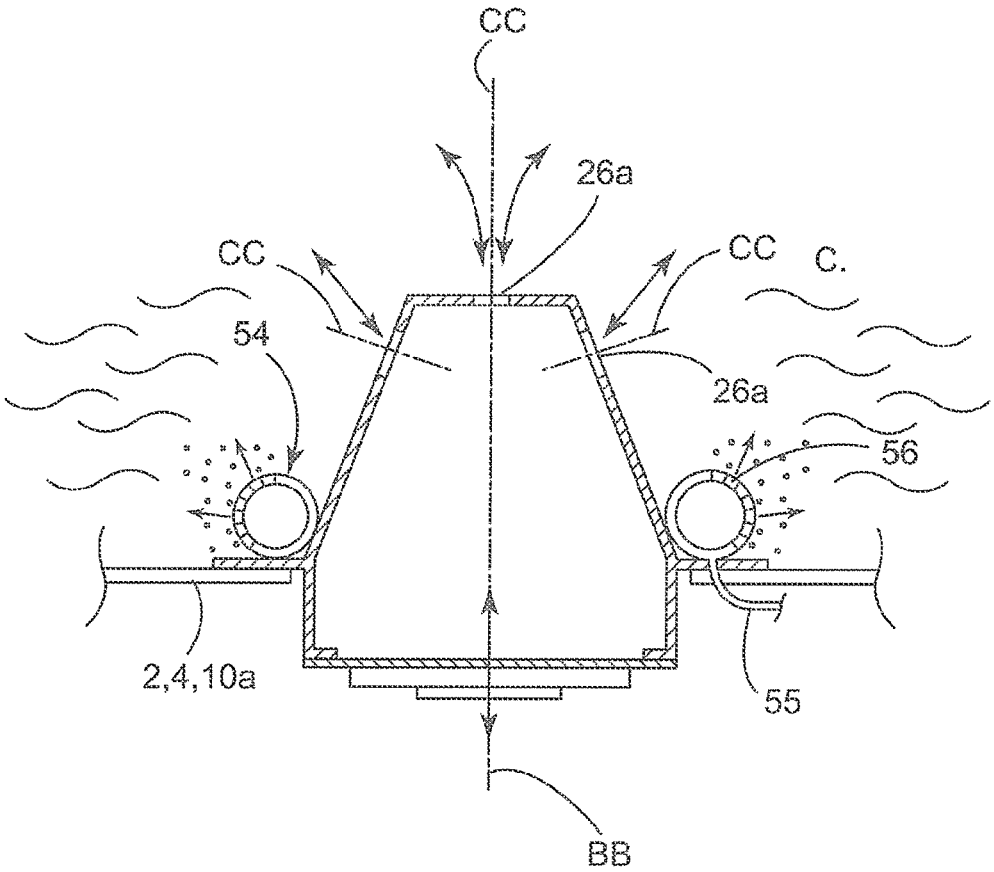
FIG. 19 is an axial cross-sectional view of another embodiment, corresponding to a variant of the embodiment of FIG. 14 but with the mixing means placed in the lower part and acting upwards, combined with aeration gas distribution means arranged at the periphery of the mixing means, supported by the sleeve of the mixing means.

In another possible configuration illustrated by FIGS. 14 and 19, the hole 34 in the given part 21 of the flexible wall 4 allows the passage of the sleeve 24, and the suction-discharge opening 26 is set axially forwards relative to the given part 21 of the flexible wall 4. With such a configuration, the mixing means 20 extend axially either partly frontwards from and partly behind or substantially frontwards from the given part 21 of the flexible wall 4.

Figure 17:
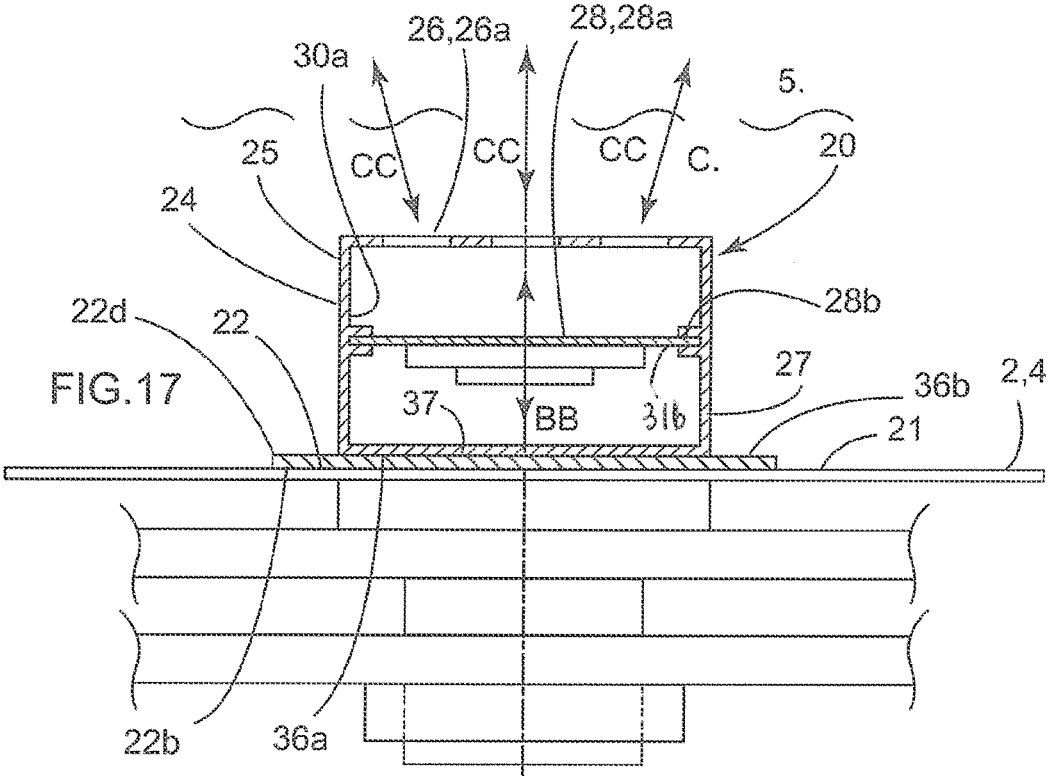
FIG. 17 is a schematic view of a cross-section along an axial plane, illustrating another embodiment in which the mixing means are placed in the lower part and act upwards, the flexible wall of the flexible container here being unpierced and without a through-hole, the rigid and leaktight connection means being solidly attached in a leaktight manner to the sleeve and to the flexible wall, the mixing means extending axially substantially forwards from the flexible wall.

In the second family of embodiments, shown in a typical representation in FIG. 17, the given part 21 of the flexible wall 4 is unpierced and the rigid and leaktight connection means 22 are solidly attached in a leaktight manner, on the one hand to the sleeve 24 by a part 36*a* external to the sleeve 24, and on the other hand to the given part 21 of the flexible wall 4 by a part 36*b* that lies flat on the flexible wall 4. With such a configuration, the mixing means 20 extend axially substantially frontwards from the given part 21 of the flexible wall 4.

In one possible embodiment which can be the object of various variants in its execution, the rigid and leaktight connection means 22 are a transverse face 22*a* of a rigid wall 22*b*. This rigid wall 22*b* is created for example of metal and is in the form of a flat plate. This rigid wall 22*b* rigidly adjoins the sleeve 24 and is rigidly secured, lying flat, in a leaktight manner, to the flexible wall 4 at or near the given part 21, typically achieved by welding or adhesive bonding although this does not exclude attachment by another equivalent means (for example crimping).

In the first structural family of the predetermined part 21 and the arrangement with mixing means 20 and rigid and leaktight connection means 22 (FIGS. 3 to 16 and 18 to 20), the rigid wall 22*b* can have an annular contour, for example circular, its inside edge 22*c* adjoining the sleeve 24 and its outer edge 22*d* at a sufficient radial distance to allow receiving the flexible wall 4 lying flat around the through-hole 34.

In the second family (FIG. 17), the rigid wall 22*b* may have a circular outline, the outside edge 22*d* having a sufficiently large radius for the rigid wall to be able to receive the sleeve 24 in its middle part while including a border area for receiving the flat flexible wall 4.

The front part 25 of the axial guiding and peripheral closure sleeve 24 is delimited internally and laterally by the lateral inside face 30*a* of the sleeve 24, and towards the back by the front inside face 31*a* of the suction-discharge part 28 in the extreme rearward sliding position. The front part 25 of the axial guiding and peripheral closure sleeve 24 is delimited at the front by the aspiration-suction opening 26. The portion of the front part 25 of the sleeve 24 located at the front of the front inside face 31*a* of the suction-discharge part 28 forms the suction-discharge cavity 29.

The rear part 27 of the axial guiding and peripheral closure sleeve 24 is delimited inside and laterally by the lateral inside face 30*a* of the sleeve 24, and towards the front by the rear face 31*b* of the suction-discharge part 28 in the extreme rearward sliding position. In addition, preferably, the axial guiding and peripheral closure sleeve 24 comprises a rear portion delimited at the back by a transverse terminal rear wall 37.

Two families of embodiments can be defined concerning the structure and the arrangement of the suction-discharge part 28.

In the first family of embodiments, shown in a typical representation in FIGS. 3 to 5 and 18, the suction-discharge part 28 is a rigid piston mounted to be leaktight at its peripheral part 28*b*, said piston sliding along axis BB, within the axial guiding and peripheral closure sleeve 24.

In the second family of embodiments, shown in a typical representation in FIGS. 8 to 17, 19 and 20, the suction-discharge part 28 is a deformable membrane having a fixed peripheral part 28*b* attached to the lateral inside face 30*a* of the axial guiding and peripheral closure sleeve 24 and a central movable part 28*a*.

In one embodiment, the suction-discharge part 28 is mounted to slide axially along axis BB between an extreme rearward position illustrated in FIGS. 8A, 9 to 17, 19 and 20, and an extreme forward position illustrated in FIGS. 3 to 5 and 18, respectively the furthest away from and the closest to the suction-discharge opening 26. In addition, in one embodiment, the suction-discharge part 28, in its extreme forward position, closes off the suction-discharge opening 26, particularly with a certain leaktightness.

Figure 8A:
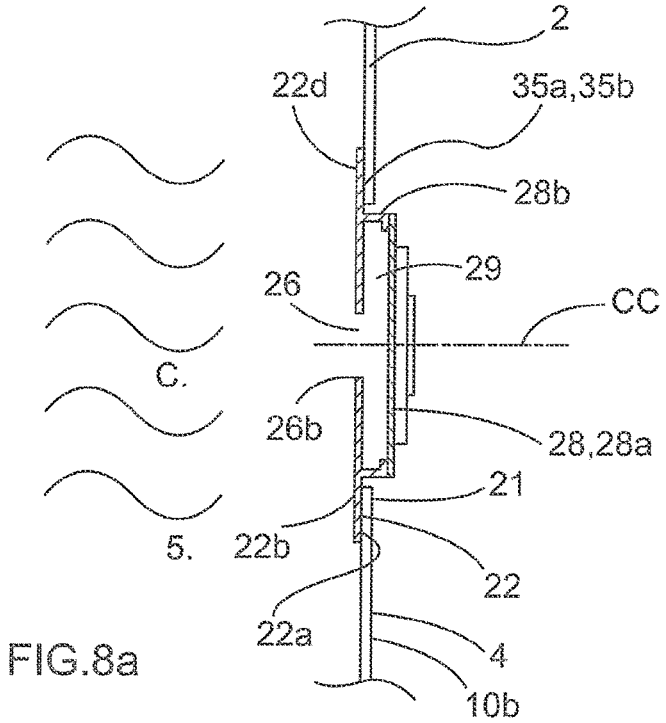
FIGS. 8A, 8B and 8C are three partial schematic views of a cross-section along an axial plane, illustrating another possible embodiment of the mixing means, with the rigid receiving and retention assembly not being represented, the mixing means being arranged on the side and acting in a generally horizontal direction, the suction-discharge part here being a deformable diaphragm, represented in the extreme rearward rest position (FIG. 8A), in the extreme forward position (FIG. 8B) at the end of the discharge portion of the cycle with the suction-discharge opening here remaining open, and in the extreme rearward position (FIG. 8C) at the end of the suction of a suction-discharge cycle.
Figure 8B:
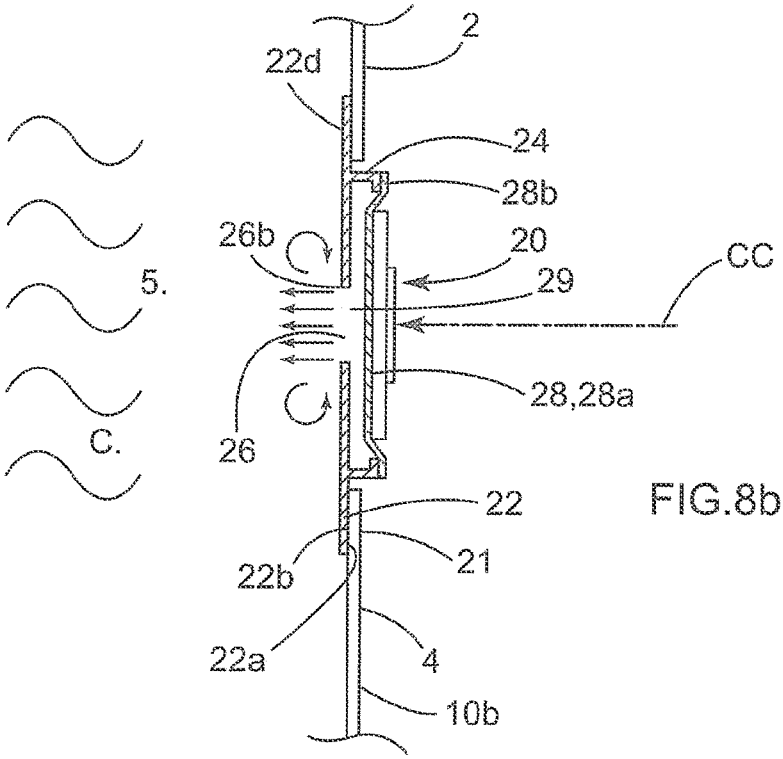
Figure 8C:
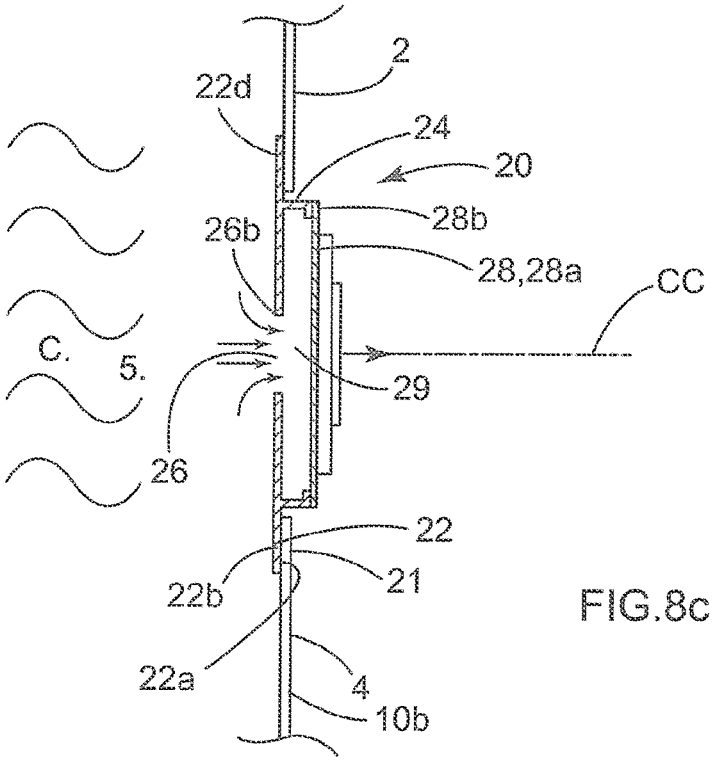

Moreover, in an embodiment shown in a typical illustration in FIGS. 8A to 8C, the suction-discharge cavity 29 is flattened transversely (perpendicularly to its axis BB), its size in the transverse direction being larger than its size in the axial direction (in the direction of the axis BB).

Various embodiments can be defined concerning the suction-discharge opening 26.

Figure 11:
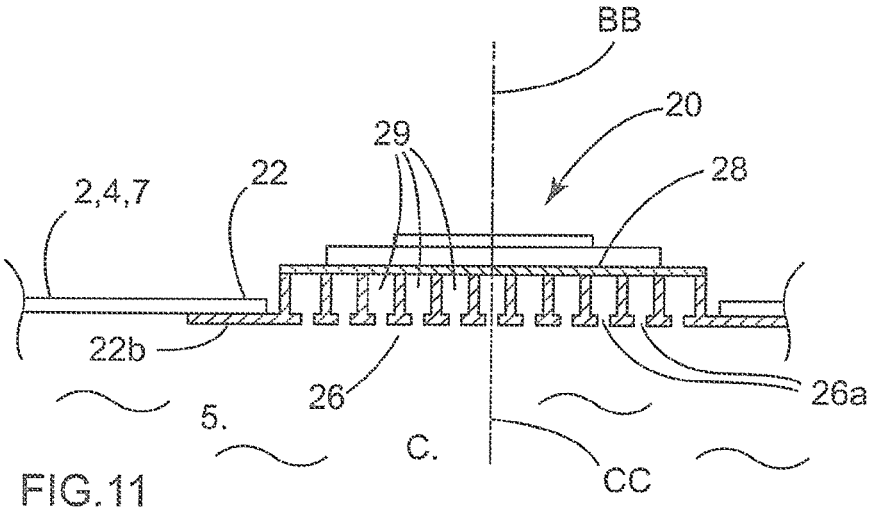

In a first aspect, the embodiments differ in the number of suction-discharge openings 26. In the embodiments illustrated in FIGS. 3 to 9, 18 and 20, the suction-discharge opening 26 is formed by a single opening able to form a single flow. In the embodiments illustrated in FIGS. 10 to 17 and 19, the suction-discharge opening 26 is formed by a plurality of basic openings 26*a*, able to form a plurality of basic flows. In this case, and depending on the embodiments, it may be arranged so that several basic openings 26*a* are associated with a single suction-discharge cavity, as illustrated by FIGS. 10, 12 to 17 and 19, or that a given basic opening 26*a* is associated with a given basic suction-discharge cavity, as illustrated in FIG. 11.

Various embodiments can be defined concerning the basic openings 26*a* when the suction-discharge opening 26 is constructed in this manner.

Figure 12:
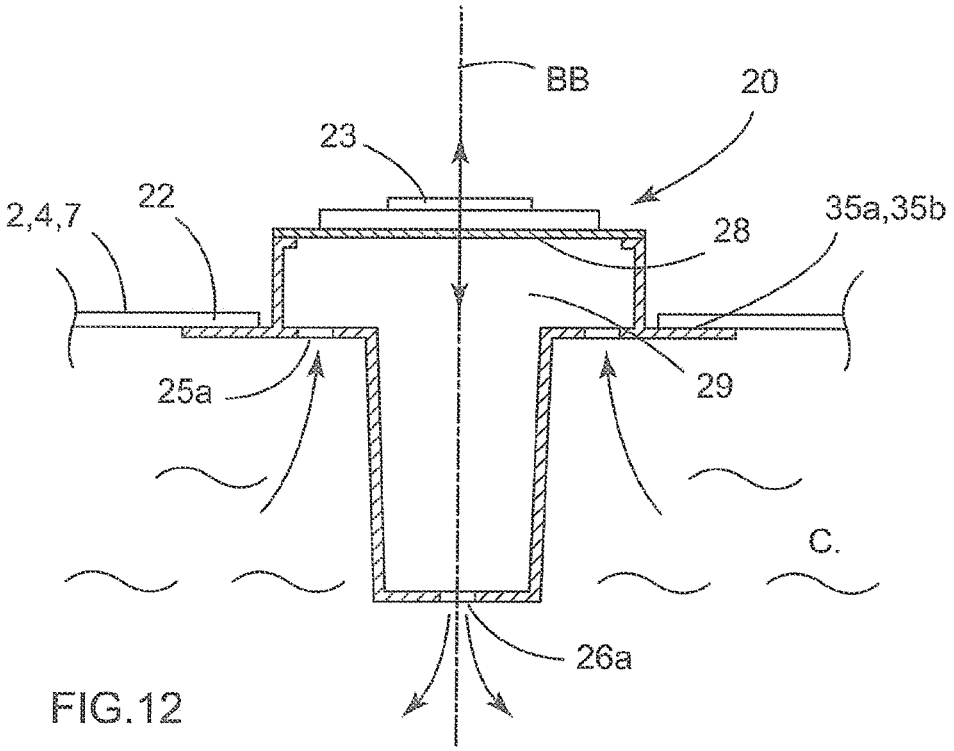
FIGS. 12, 13, 14, 15 and 16 are five schematic views of a cross-section along an axial plane, illustrating five other variant embodiments in which the mixing means are placed in the top portion and act downwards: with a plurality of basic openings spaced apart in the axial direction, distanced from the flexible wall of the flexible container and located within the inside space of the flexible container (FIG. 12); with a plurality of basic openings arranged along angled axes, here at right angles, the basic openings being placed near the flexible wall of the flexible container (FIG. 13); with a plurality of basic openings angled relative to the axis of the mixing means (FIG. 14); with a plurality of basic openings placed side by side in the transverse direction, offset towards the back relative to the flexible wall of the flexible container (FIG. 15); or with a plurality of basic openings arranged on a knob-shaped suction-discharge part, the drive means comprising means which are pneumatic in nature, for sequentially driving an axial movement in the two opposite directions (FIG. 16).
Figure 13:
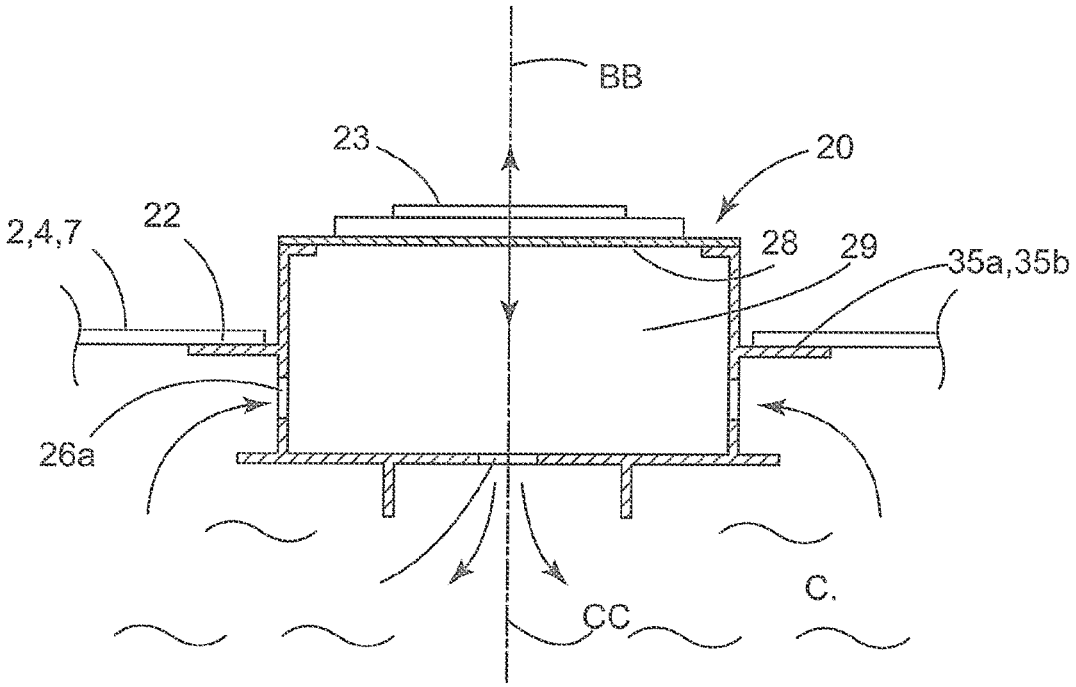
Figure 16:
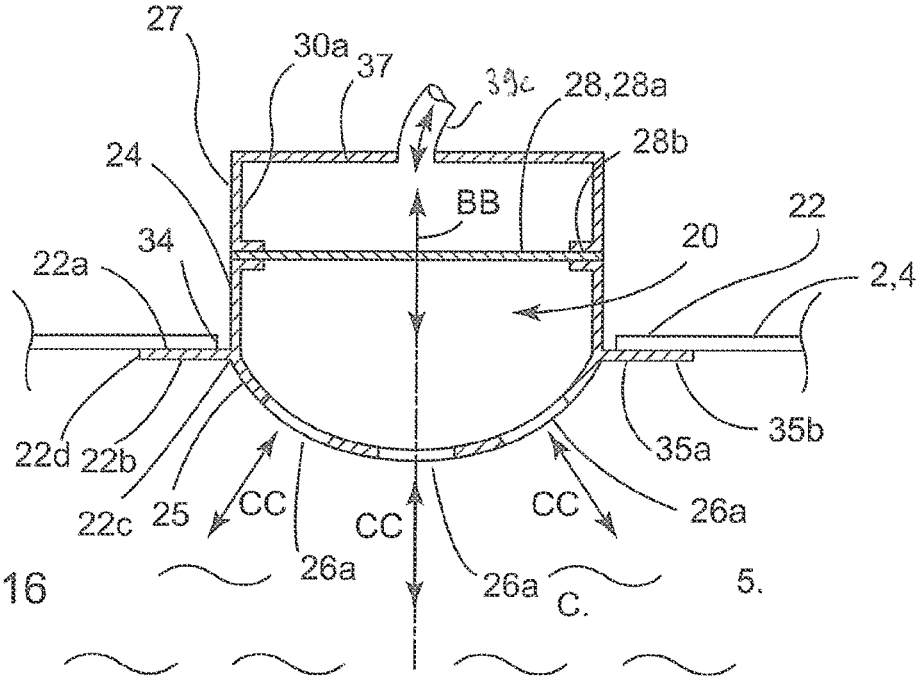

For the arrangement of the basic openings 26*a* relative to the axis BB, it can be arranged so that there are several basic openings 26*a* located side by side in a same transverse direction perpendicular to the axis BB, as illustrated in FIGS. 10, 11, 15 and 17, or several basic openings 26*a* spaced apart in the axial direction along the axis BB, as illustrated in FIGS. 14 and 16, or it is possible to combine basic openings 26*a* located side by side in a same transverse direction and spaced apart in the axial direction, as illustrated in FIGS. 12, 13 and 19. These constructional features allow creating a flow of content that will achieve effective mixing and is adapted to the context.

Concerning the arrangement of the basic openings 26*a* relative to each other, it can be arranged so that the axes CC of several basic openings 26*a* are parallel to each other, as illustrated in FIGS. 10 and 12, 15 and 17, or are angled relative to each other as illustrated in FIGS. 12 to 14, 16 and 19, for example forming an acute or 90° angle. These constructional features allow creating a flow of content that will achieve effective mixing and is adapted to the context.

Figure 9:
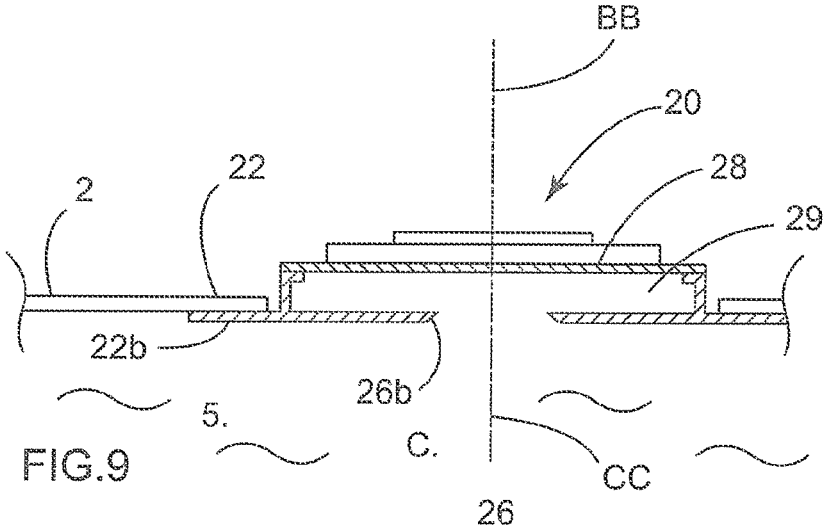
FIGS. 9, 10 and 11 are three diagrams analogous to the diagrams in FIGS. 8A, 8B and 8C, but with the mixing means arranged in the top part and acting downwards, illustrating different possible embodiments of the suction-discharge opening and the suction-discharge part, specifically a single opening with an angled peripheral edge (FIG. 9), a suction-discharge opening formed by a plurality of basic openings placed side by side in the transverse direction in combination with a single suction-discharge cavity (FIG. 10), and a suction-discharge opening formed by a plurality of basic openings placed side by side in the transverse direction in combination with a same plurality of suction-discharge cavities (FIG. 11).
Figure 10:
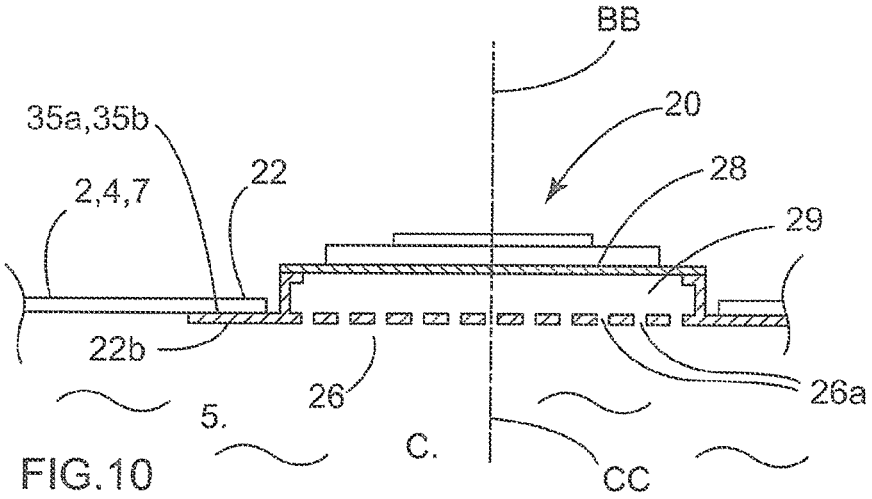

Whether there is one suction-discharge opening or multiple basic suction-discharge openings 26*a*, there can be different embodiments concerning the shape of the opening, and particularly the shape of its peripheral edge 26*b*. For example, the peripheral edge 26*b* may extend in the axial direction (along axis BB or axis CC), as illustrated in FIGS. 5 to 8 and 10 to 20, or in a direction that is angled relative to axis BB or CC, as illustrated in FIG. 9. Thus a flow of content can be formed which extends either in the axial direction or in a direction that is angled relative to axis BB or CC, and, more generally, which will achieve effective mixing and is adapted to the context.

It is also possible to arrange a suction-discharge opening 26, 26*a* in association with flow orientation means and/or shaping means and/or concentration means and/or spreading means, allowing the flow to be oriented and/or shaped and/or concentrated and/or spread out, these constructional features aiming to create a flow of content which will achieve effective mixing and is adapted to the context. For example, in the embodiment in FIG. 6, there is a baffle guide 38 bordering the suction-discharge opening 26 along part of its circumference, located outside the suction-discharge cavity 29.

Figure 7:
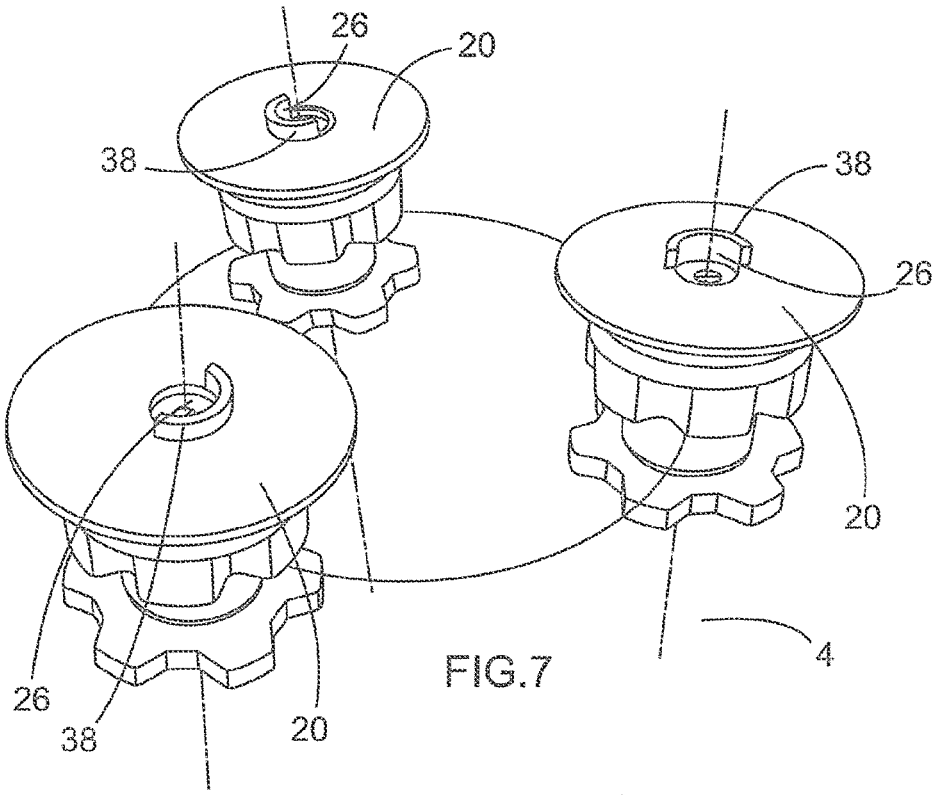

The constructional features which have just been described may be combined with each other except where clearly impossible, as the embodiments represented in the figures are only non-limiting examples. In addition, they may be combined with the different variant arrangements of the mixing means units 20 on a flexible container 2, as was described above in relation to FIGS. 2A to 2F. For example, FIG. 7 shows an embodiment with three mixing means units 20 arranged with their axes BB parallel to each other and side by side to form a triangle, in the same region of the flexible wall 4, and with the suction-discharge openings 26 comprising baffle guides 38 judiciously oriented relative to one another.

Various embodiments can be defined concerning the drive means 23.

Figure 5:
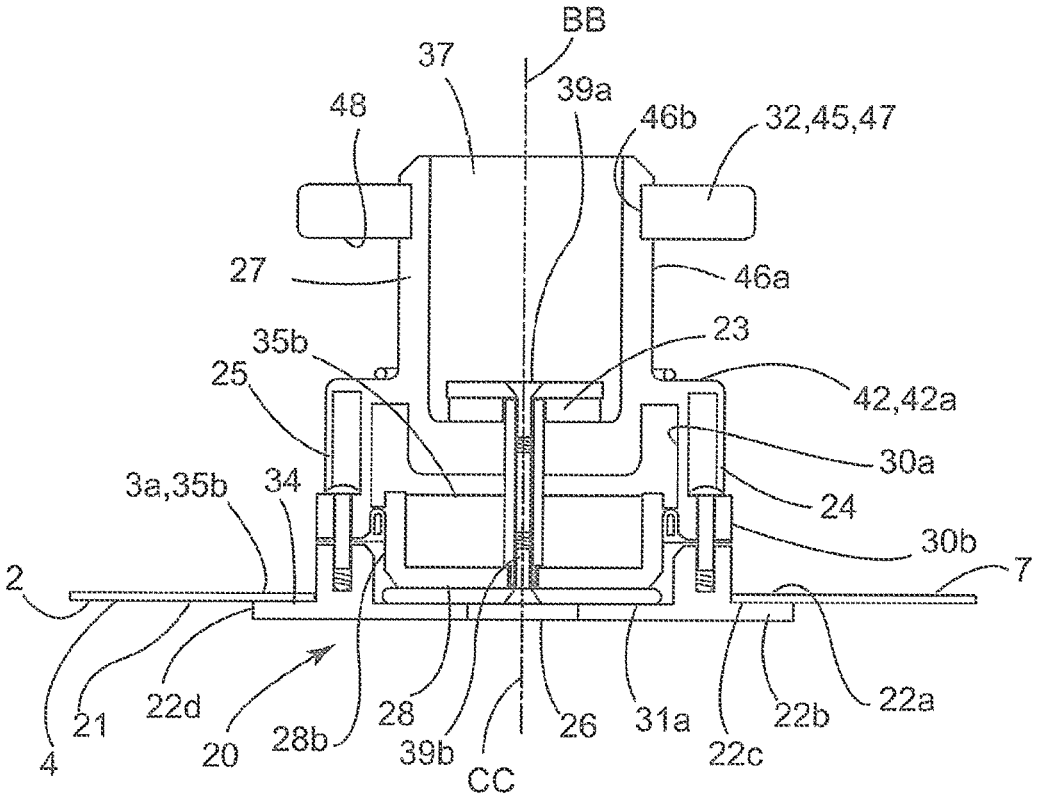
FIG. 5 is an axial cross-sectional view corresponding to FIG. 4.
Figure 6:
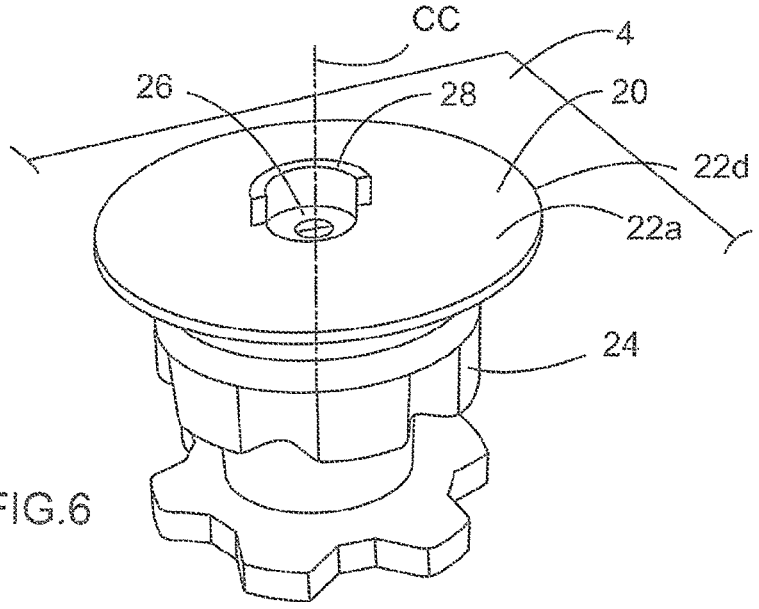
FIGS. 6 and 7 are two perspective views of the front part of the mixing means, illustrating two other possible embodiments, which are respectively an embodiment in which a baffle is associated with the suction-discharge opening, and an embodiment with three mixing units arranged in a triangle and a baffle associated with the suction-discharge opening of each of them, the unit(s) being arranged in the lower portion and acting upwards.
Figure 18:
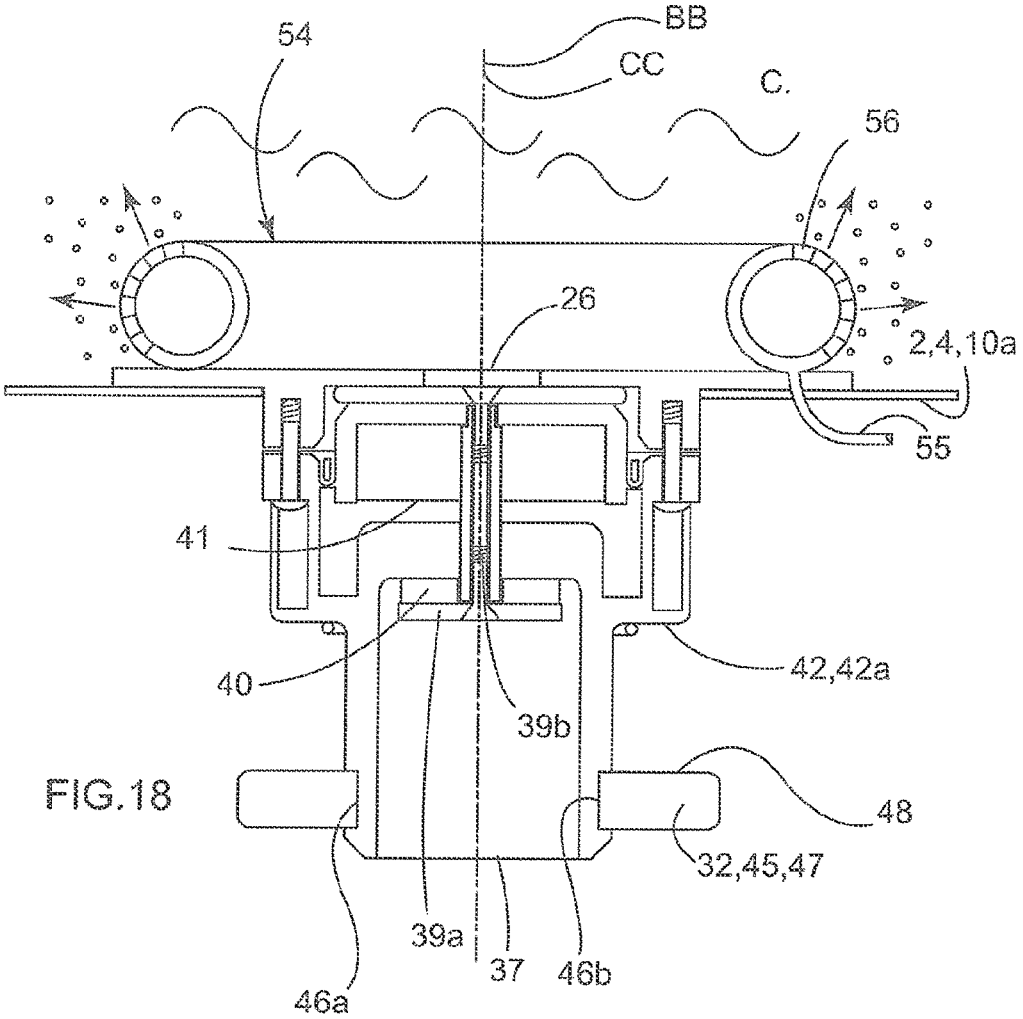
FIG. 18 is an axial cross-sectional view of another embodiment, corresponding to FIG. 5 but with the mixing means placed in the lower part and acting upwards, combined with aeration gas distribution means placed at the periphery of the mixing means, supported by the rigid and leaktight connection means.

In a first family, illustrated in FIGS. 5 and 18, the drive means 23 comprise means 39*a* for driving axial movement in one direction, combined with axial return means 39*b* for the opposite direction. In a second family, illustrated in FIG. 16, the drive means 23 comprise means 39*c* for driving axial movement in the two opposing directions sequentially.

Thus, for example, in the case of the first family of drive means 23 (FIGS. 5 and 18), the means 39*a* for driving an axial movement in a direction can be electromechanical or electromagnetic means, while the means 39*b* for axial return in a direction can be elastic means such as a spring. There can be a movable plunger core 40 arranged transversely in the sleeve 24 behind the suction-discharge part 28, mounted to slide alternately forward and backward axially. On the other hand, an axially sliding connection member 41 can be arranged to connect the movable plunger core 40 and the suction-discharge part 28, which is a piston here. The means 39*a* for driving an axial movement and the axial return means 39*b* act on the movable plunger core 40 which is moved in an axial direction by the effect of these means 39*a* and 39*b*, alternately forwards and backwards, due to the electromechanical or electromagnetic means provided for this purpose.

In the case of the second family (FIG. 16), the means 39*c* for driving an axial movement sequentially in the two opposing directions can be pneumatic means which move the suction-discharge part 38, specifically its movable part 38*a*.

In the above embodiments, the drive means 23 extend axially substantially behind the suction-discharge part 28 and are positioned externally to the inside space 5 where the content can be found. In certain embodiments previously described, as illustrated in FIGS. 5, and 9 to 13, the drive means 23 extend axially substantially behind the given part 21 of the flexible wall 4.

Various embodiments can be defined concerning the structure of a drive means unit 23, a suction-discharge part unit 28, and the suction-discharge cavity unit 29. In the embodiments represented, a drive means unit 23 is associated with a suction-discharge part unit 28. In other possible embodiments, the same drive means unit 23 is associated with multiple suction-discharge part units 28 and/or suction-discharge cavity units 29. This arrangement is well-suited for the case of multiple adjacent mixing means units.

In general, the immobilization means 32 firstly comprise an application face 42 rigidly adjoining the sleeve 24 and an abutting face 43 of a supporting part 44, in an arrangement where the given part 21 of the flexible wall 4 and the abutting face 43 of the supporting part 44 have a fixed relative position. The immobilization means 32 secondly comprise fixed and rigid retention means 45 for retaining the application face 42 applied in a fixed and rigid manner to the abutting face 43.

In the embodiments, the fixed and rigid retention means 45 are arranged in a detachable or non-detachable manner, the mixing means 20 then being mounted on the flexible container in a manner that is respectively removable or permanent.

Various embodiments can be defined concerning the immobilization means 32.

We will now refer to FIGS. 3 to 5 and 18 which illustrate a first embodiment of the immobilization means 32. In this first embodiment, the fixed and rigid retention means 45 comprise a clamping member in the form of an external thread 46*a* rigidly adjoining the sleeve 24, which cooperates, in clamping, with a complementary clamping member in the form of an internal thread 46*b* of an immobilization part 47 having a second application face 48 placed against and retained in a fixed and rigid manner on a second abutting face 49 of a second supporting part, it being noted that the given part 21 of the flexible wall 4 and the second abutting face 49 of the second supporting part have a relative fixed position. In this embodiment, the immobilization means 32 secondly comprise the application face 42 which constitutes a first application face 42 rigidly adjoining the sleeve 24, and the abutting face 43 which constitutes a first abutting face 43 of the supporting part 44 which constitutes a first supporting part 44. In this embodiment, the first application face 42 and the second application face 48 are arranged transversely and are oriented in two opposite axial directions, and the first abutting face 43 and the second abutting face 49 are also arranged transversely and oriented in two opposite axial directions.

For example, the first application face 42 is in the form of a transverse shoulder 42*a* of the peripheral lateral external face 30*b* of the sleeve 14, said shoulder 42*a* facing rearwards, such that the sleeve 24 has a front part 25 of larger external transverse size (radius) and a rear part 27 of smaller external transverse size (radius). Also, the immobilization part 47 is then a nut whose internal screw thread 46*b* is the clamping member 46*b*, said screw thread 46*b* cooperating with an external screw thread 46*a* which is the clamping member 46*a* adjoining the sleeve 24.

For example, the first supporting part 44 is a first rigid wall and the second supporting part 50 is a second rigid wall. These two rigid walls 44 and 50 are arranged substantially parallel to each other and are spaced apart while remaining near one another. They comprise two through-holes 51*a* and 51*b*, arranged facing one another and in communication with each other to allow the passage of the sleeve 24, both when it is in motion when it slides into place and statically when it is immobilized.

In addition, and for example, the first rigid wall 44 and/or the second rigid wall 50 comprise a housing cavity, respectively 52*a* and 52*b*, which respectively seats the front part 25 and/or the rear part 27 of the sleeve 24. With this constructional feature, it is possible to arrange the mixing means 20 and the immobilization means 32 so that they are substantially between the two free opposing faces, respectively the front face 53*a* of the first rigid wall 44 and the rear face 53*b* of the second rigid wall 50.

In addition, and for example, the first supporting part 44 and the second supporting part 50 are an integral part of the receiving and retention assembly 3 for the flexible container.

In another embodiment, the fixed and rigid retention means 45 for the application face 42 applied in a fixed and rigid manner to the abutting face 43 are adhesive bonding means or welding means.

In an embodiment in which the suction-discharge part 28, in its extreme forward position, closes off the suction-discharge opening 26, it is arranged so that the control means 33 control the drive means 23 of the movable displacement means (28, 28*a*) so that when finished functioning the suction-discharge part 28 is in its extreme forward position where it closes off the suction-discharge opening 26.

In one development of the invention illustrated in FIGS. 18 and 19, the receptacle for biopharmaceutical use 1 additionally comprises aeration means 54, able to deliver aeration gas to the content in the inside space 5.

Such aeration means 54 firstly comprise aeration gas supply means 55 having at least one tubular element extending upstream in a fluid communication from outside the flexible container 2.

Such aeration means 54 next comprise aeration gas distribution means 56, communicating downstream with the supply means 55. The distribution means 56 are typically in the form of a wall equipped with aeration holes. For example, this wall has a general toric shape with an axial cross-section that is generally circular. Such distribution means 56 are located within the inside space 5 and they are rigidly supported by a part forming a fixed peripheral support which is part of the mixing means 20 or the rigid and leaktight connection means 22. Thus the mixing means and the aeration means are combined into the same structural assembly.

The arrangement of the structure of the association of the distribution means 56 and the mixing means 20 or rigid and leaktight connection means 22 can be the object of different variant embodiments. Thus the distribution means 56 may be placed at the edge of the mixing means 20 (FIG. 19) or at the edge of the rigid and leaktight connection means 22 (FIG. 18). In addition, the distribution means 56 may either be adjacent to or distanced from the mixing means 20 or rigid and leaktight connection means 22.

Figure 20:
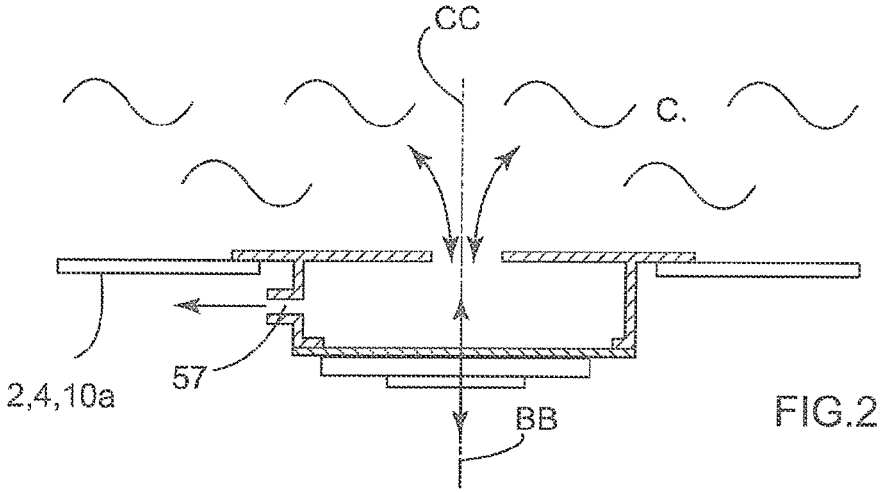
FIG. 20 is an axial cross-sectional view of another embodiment in which means for collecting a sample of the content from the inside space are provided.

In another development of the invention illustrated in FIG. 20, the receptacle for biopharmaceutical use 1 additionally comprises means 57 for collecting a sample of the content in the inside space 5, opening into the suction-discharge cavity 29, with a movable shut-off valve where necessary.

The invention also concerns the rigid receiving and retention assembly 3 for the flexible container 2 of a receptacle for biopharmaceutical use 1 as described above.

This assembly 3 is such that the inside face of the bottom wall 11 and of the side wall 12 forms, facing the mixing means 20 of a receptacle 1, an abutting face 43, 50 that is part of the immobilization means 32 for the mixing means 20.

As indicated, such an assembly 3 comprises two rigid walls arranged substantially parallel to each other, 16 and 17 or 44 and 50, which comprise two facing through-holes 51*a* and 51*b* to allow the passage during assembly or the retention of the sleeve 24 of the mixing means 20.

In addition, such an assembly 3 can comprise the cavities 42*a* and 52*b* already described.

To make use of a receptacle for biopharmaceutical use 1 as described above, one begins by being provided with a receptacle for biopharmaceutical use 1 as well as a generally liquid or pasty biopharmaceutical product or one or more components of such a product.

Then the inside space 5 of the flexible container 2 is filled with the biopharmaceutical product or with one or more components, to form the content C of the flexible container 2. The suction-discharge cavity 29, which is in communication with the inside space 5, is filled with said content.

When the content C of the flexible container 2 is to be mixed, the drive means 20 are put to use.

During said use, the movable part 28*a* of the suction-discharge part 28 is displaced in at least one (and usually several) sequence of sliding alternately forwards and backwards axially.

Thus the volume of the suction-discharge cavity 29 undergoes at least one (and usually several) sequence of alternately compressing and expanding.

In this manner, in alternation, the content inside the suction-discharge cavity 29 is discharged into the inside space 5 through the suction-discharge opening 26 and the content of the inside space 5 is sucked into the suction-discharge cavity 29 through the suction-discharge opening 26.

Due to this or these sequences, the content C of the flexible container 2 adjacent to the suction-discharge opening 26 is moved about. And due to this movement, the content of the flexible container 2 is mixed.

In one embodiment, when the use of the drive means 23 ends, the suction-discharge part 28 is brought to its extreme forward position where it closes off the suction-discharge opening 26.

In one embodiment, there is at least one additional step, in which the inside space 5 of the flexible container 2 is filled with biopharmaceutical product or one or several components.

In one embodiment, the drive means 23 are controlled—starting, stopping, speed, frequency, displacement—as a function of a control parameter, such as the time or the degree of homogeneity/heterogeneity of the content in the flexible container, using the measurement means 9*a*.

In another embodiment, the rigid receiving and retention assembly 3 for the flexible container 2 is put to use.

In another embodiment, the mixing and the aeration of the content C in the inside space 5 are combined.

In another embodiment, the mixing is combined with collecting the sample of content C in the inside space 5.

The above description more particularly relates to a receptacle 1 which constitutes a mixing vessel.

Figure 21:
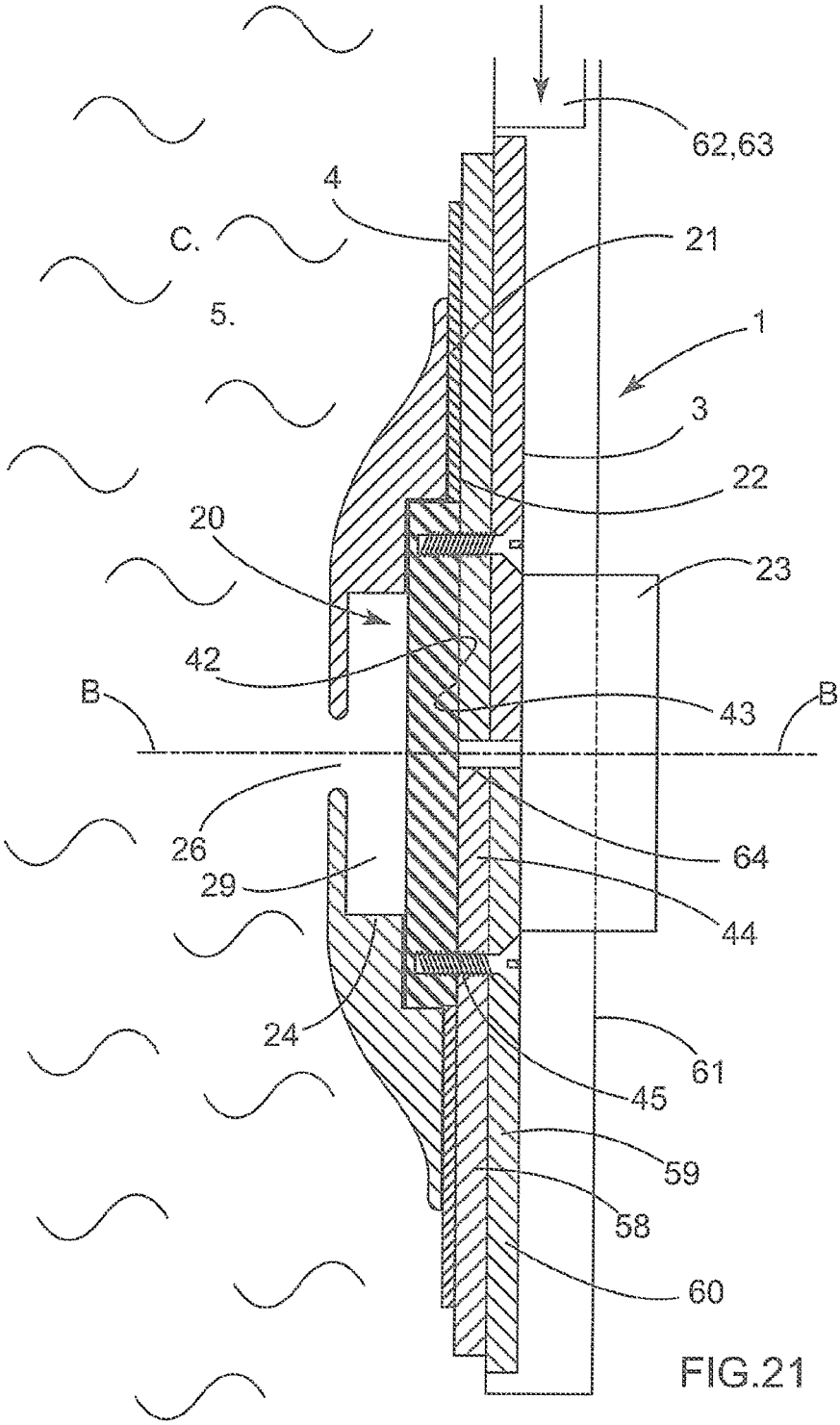
FIG. 21 is a cross-sectional view of another embodiment concerning an application involving a rigid receiving and retention assembly which is part of a freezing/thawing system.

However, the invention also applies to the case where the receptacle 1 constitutes a freezing/thawing vessel, as illustrated in a possible embodiment provided purely as a non-limiting example in FIG. 21.

In this embodiment, the application face 42 is the rear face of a transverse shoulder at the end of the sleeve 24 and the abutting face 43 is the front face of a supporting part 44 which is part of the rigid receiving and retention assembly 3 belonging to a freezing/thawing system.

The supporting part 44 here comprises two walls 58 and 59, pressing against one another within the region of the application face 42. Wall 58 is internal and at the front and wall 59 is external and at the back.

Wall 58 delimits the side part of the rigid receiving and retention assembly 3. The flexible wall 4 presses against its front face. This wall 58, more specifically each side panel of this wall, has a front face that is planar or substantially planar.

Wall 59 is undulated parallel to the inlet/outlet axis of the flexible container 2 in the rigid receiving and retention assembly 3. It thus has front parts 60 and rear parts 61 connected by connecting parts.

In its front parts 60, the front face of the rear wall 59 presses against the rear face of the front wall 58. Where applicable, the two walls 58 and 59 are positively secured at these parts 60, or at least adjusted. It is here at these parts 60 that the two walls 58 and 59 press against one another, in the area of the application face 42.

Away from the area of the application face 42, in the rear parts 61, the two walls are spaced apart from one another and thus define a free space 62 between them.

This free space 62 is able to receive and accommodate a heat transfer means 63, such as a source of heat or cold. This heat transfer means 63 thus comprises parts shaped like flat parallelograms in order to cooperate with the successive free spaces 62. These parts can be connected at their upper end, giving the heat transfer means 63 a general comb shape.

In this manner, the fixed and rigid retention means 45 for the application face 42 applied in a fixed and rigid manner to the abutting face 43 can be screws traversing holes in the walls 58 and 59, screwed from the back into holes tapped in the transverse shoulder at the end of the sleeve 24, the head of the screws resting on the beveled edges of the holes in walls 58 and 59.

A passage 64, to allow the passage of the drive means 28, is arranged in the front part 60 of the walls 58 and 59.

Attachment means for the drive means 23 are also provided.

With such a freezing/thawing system, the flexible container 2 is arranged so that the mixing means 20 are placed facing the passage 64. Then the mixing means are attached by means of the screws of the fixed and rigid retaining means 45. Then the drive means 23 are attached.

When necessary, the heat transfer means 63 is placed in the free space 62. And, when necessary, the mixing means 20 are put to use.

The invention claimed is:

1. Receptacle (1) for biopharmaceutical use, comprising:

a flexible container (2) having a flexible wall (4) delimiting, at a front, an inside space (5) able to receive content that is a biopharmaceutical product which is generally liquid or pasty at least when it is to be mixed, mixing means (20) able to mix the content of the inside space (5), adjacent to a given part (21) of the flexible wall (4), including movable displacement means (28*a*) adjoining the inside space (5) and able to displace the content, drive means (23) for driving the movable displacement means (28*a*), and rigid and leaktight connection means (22) ensuring a rigid and leaktight connection between the mixing means (20) and the given part (21) of the flexible wall (4), characterized by the fact that:

the mixing means (20) comprise:

an axial guiding and peripheral closure sleeve (24) which is rigid, has a lateral inside face, has a constant transverse cross-section along its axis (BB), and has towards its front part (25) a suction-discharge opening (26) adjoining the inside space (5), a suction-discharge part (28) which is unpierced and arranged transversely in the sleeve (24) in a leaktight manner, has a front inside face, and of which at least one movable part (28*a*) is mounted to slide alternately forwards and backwards axially, a suction-discharge cavity (29), delimited by the lateral inside face (30*a*) of the sleeve (24) and the front inside face (31*a*) of the suction-discharge part (28), in communication with the inside space (5) via the suction-discharge opening (26), the drive means (23) are able to drive the movable part (28*a*) of the suction-discharge part (28) and assure its movement in at least one sequence of sliding alternately forwards and backwards axially such that the volume of the suction-discharge cavity (29) has at least one sequence of alternately compressing and expanding, and thus the content of the flexible container (2) adjacent to the suction-discharge opening (26) is moved about and the content of the flexible container (2) is mixed, immobilization means (32) ensure the relative immobilization of the axial guiding and peripheral closure sleeve (24) and of the given part (21) of the flexible wall (4), including during the sliding axial movement of the movable part (28*a*) of the suction-discharge part (28).

2. Receptacle (1) for biopharmaceutical use according to claim 1, wherein the given part (21) of the flexible wall (4) comprises a mounting through-hole (34), with which the mixing means (20) are axially associated, and wherein the rigid and leaktight connection means (22) are secured in a leaktight manner on the one hand to the sleeve (24) by a side part (35*a*) that is peripheral and external to the sleeve (24), and on the other hand to the given part (21) of the flexible wall (4) by a peripheral portion (35*b*) around the mounting through-hole (34) and lying flat on the flexible wall (4).

3. Receptacle (1) for biopharmaceutical use according to claim 2, wherein the hole (34) in the given part (21) of the flexible wall (4) allows passage of the sleeve (24), and wherein the suction-discharge opening (26) is axially substantially adjacent to the flexible wall (4), the mixing means (20) extending axially substantially rearwards from the given part (21) of the flexible wall (4), or wherein the hole (34) in the given part (21) of the flexible wall (4) provides the communication between the suction-discharge cavity (29) and the inside space (5), and wherein the suction-discharge opening (26) is axially offset rearwards from the given part (21) of the flexible wall (4), the mixing means (20) extending axially substantially rearwards from the given part (21) of the flexible wall (4), or wherein the hole (34) in the given part (21) of the flexible wall (4) allows passage of the sleeve (24), and wherein the suction-discharge opening (26) is axially offset frontwards from the given part (21) of the flexible wall (4), the mixing means (20) extending axially either partially frontwards and partially rearwards or substantially frontwards from the given part (21) of the flexible wall (4).

4. Receptacle (1) for biopharmaceutical use according to claim 1, wherein the given part (21) of the flexible wall (4) is unpierced, the rigid and leaktight connection means (22) are secured in a leaktight manner to the sleeve (24) by a part (36*a*) external to the sleeve (24) and to the given part (21) of the flexible wall (4) by a part (36*b*) lying flat on the flexible wall (4), and wherein the mixing means (20) extend axially substantially frontwards from the given part (21) of the flexible wall (4).

5. Receptacle (1) for biopharmaceutical use according to claim 1, wherein the rigid and leaktight connection means (22) comprise a transverse face (22*a*) adjoining the sleeve (24), rigidly secured, to lie flat, in a leaktight manner, to the flexible wall (4) at or near the given part (21).

6. Receptacle (1) for biopharmaceutical use according to claim 1, wherein the axial guiding and peripheral closure sleeve (24) comprises a front part (25) laterally delimited by the lateral inside face (30*a*) of the sleeve (24), delimited at a back by the front inside face (31*a*) of the suction-discharge part (28) in an extreme rearward sliding position, and delimited at the front by the suction-discharge opening (26).

7. Receptacle (1) for biopharmaceutical use according to claim 1, wherein the axial guiding and peripheral closure sleeve (24) comprises a rear part (27) laterally delimited by the lateral inside face (30*a*) of the sleeve (24) and delimited at the front by a rear face of the suction-discharge part (28) in the extreme rearward sliding position, and in particular wherein the sleeve (24) comprises a rear part delimited at the back by a transverse terminal rear wall (37).

8. Receptacle (1) for biopharmaceutical use according to claim 1, wherein the suction-discharge part (28) is either a rigid piston mounted in the sleeve (24) or a deformable membrane having a fixed peripheral part (28*b*) attached to the lateral inside face (30*a*) of the sleeve (24) and a central movable part (28*a*).

9. Receptacle (1) for biopharmaceutical use according to claim 1, wherein the suction-discharge part (28) is mounted to slide axially between an extreme rearward position and an extreme forward position, respectively further from and closer to the suction-discharge opening (26), and optionally when in its extreme forward position, the suction-discharge part (28) closes off the suction-discharge opening (26).

10. Receptacle (1) for biopharmaceutical use according to claim 1, wherein the suction-discharge cavity (29) is transversely flattened, its size in the transverse direction being larger than its size in the axial direction.

11. Receptacle (1) for biopharmaceutical use according to claim 1, wherein the suction-discharge opening (26) is formed either by a single opening able to shape a single flow or by a plurality of basic openings (26*a*) able to shape a plurality of basic flows.

12. Receptacle (1) for biopharmaceutical use according to claim 1, wherein a suction-discharge opening (26) is associated with flow orientation means (38) and/or shaping means and/or concentration means and/or spreading means, able to orient and/or shape and/or concentrate and/or spread out a flow, wherein in particular the suction-discharge opening (26, 26*a*) comprises a peripheral edge (26*b*) which extends either in an axial direction along an axis or in a direction that is angled relative to said axis, able to form a flow which extends either in the axial direction or in a direction that is angled relative to said axis.

13. Receptacle (1) for biopharmaceutical use according to claim 1, wherein the drive means (23) comprise means (39*a*) for driving an axial movement in one direction combined with means (39*b*) for axial return in the opposite direction, in particular wherein the means (39*a*) for driving an axial movement in the one direction are electromechanical or electromagnetic means and the means (39*b*) for axial return in the opposite direction are elastic means such as a spring, in particular wherein the drive means (23) comprise means (39*c*) for driving an axial movement sequentially in the two opposing directions, such as pneumatic means, and optionally said receptacle comprises a movable plunger core (40), arranged transversely in the sleeve (24) behind the suction-discharge part (28) and mounted to slide alternately forwards and backwards axially, and wherein it comprises an axially sliding connection member (41) connecting the movable plunger core (40) and the suction-discharge part (28), the means (39*a*) for driving an axial movement in the one direction and the means (39*b*) for axial return in the opposite direction acting on the movable plunger core (40).

14. Receptacle (1) for biopharmaceutical use according to claim 1, wherein the immobilization means (32) comprise an application face (42) rigidly adjoining the sleeve (24) and an abutting face (43) of a supporting part (44), the given part (21) of the flexible wall (4) and the abutting face (43) of the supporting part (44) having a fixed relative position, and fixed and rigid retention means (45) for retaining said application face (42) applied in a fixed and rigid manner to said abutting face (43), arranged to be detachable or non-detachable.

15. Receptacle (1) for biopharmaceutical use according to claim 14, wherein the fixed and rigid retention means (45) for retaining said application face (42) applied in a fixed and rigid manner to said abutting face (43) comprise a clamping member (46*a*) rigidly adjoining the sleeve (24) which cooperates, in clamping, with a complementary clamping member (46*b*) of an immobilization part (47) having a second application face (48) applied to and retained in a fixed and rigid manner on a second abutting face (49) of a second supporting part (50), the given part (21) of the flexible wall (4) and the second abutting face (49) of the second supporting part (50) having a fixed relative position, or wherein the application face (42) is a rear face of a transverse shoulder at an end of the sleeve (24), the abutting face (43) is a front face of a supporting part (44, 60), and the fixed and rigid retention means (45) for retaining said application face (42) applied in a fixed and rigid manner against said abutting face (43) are mutual clamping means, the supporting part (44) being part of a rigid receiving and retention assembly of a freezing/thawing system.

16. Receptacle (1) for biopharmaceutical use according to claim 15, wherein the supporting part (44, 60) and the rigid receiving and retention assembly of the freezing/thawing system comprises two walls pressing against one another about the application face (42) and spaced apart from one another in one or more areas distanced from the application face (42) in order to leave a free space suitable for accommodating a heat transfer means, and optionally the supporting part (44) of the rigid receiving and retention assembly of the freezing/thawing system comprises a passage to allow passage of the drive means (23).

17. Receptacle (1) for biopharmaceutical use according to claim 1, wherein it additionally comprises control means (33) for controlling the drive means (23) of the movable displacement means and/or means (9*a*) which respond to a control parameter of the control means (33) to which the control means (33) are coupled in a responsive manner, and wherein the suction-discharge part (28) when in its extreme forward position closes off the suction-discharge opening (26), characterized by the control means (33) controlling the drive means (23) of the movable displacement means (28*a*, 28) so that when finished functioning, the suction-discharge part (28) is in its extreme forward position where it closes off the suction-discharge opening (26).

18. Receptacle (1) for biopharmaceutical use according to claim 1, wherein a mixing means unit (20) is located either on a bottom part (10*a*) or on a side part (10*b*) or on a top part (7) of the flexible wall (4) of the flexible container (2), and wherein it comprises a single mixing means unit (20) or a plurality of mixing means units (20).

19. Receptacle (1) for biopharmaceutical use according to claim 1, wherein it additionally comprises aeration means (54) able to deliver aeration gas to the content, comprising aeration gas supply means (55) having at least one tubular element extending in a fluid communication from outside the flexible container (2) to aeration gas distribution means (56) located within the inside space (5) of the flexible container (2) and rigidly supported by a part forming a fixed peripheral support which is part of the mixing means (20) or of the rigid and leaktight connection means (22), in particular with the aeration gas distribution means (56) arranged at the periphery of the mixing means (20) or of the rigid and leaktight connection means (22), in an adjoining manner or at a distance away.

20. Receptacle (1) for biopharmaceutical use according to claim 1, wherein it additionally comprises means (57) for collecting a sample of the content of the inside space (5), opening into the suction-discharge cavity (29).

21. Receptacle (1) for biopharmaceutical use according to claim 1, wherein it constitutes a mixing vessel or a bioreactor or a freezing/thawing vessel.

22. A method for making use of the receptacle for biopharmaceutical use according to claim 1, wherein:

biopharmaceutical product is provided which is generally liquid or pasty at least when it is to be mixed, or one or more components of such a product, the inside space (5) of the flexible container (2) is filled with said biopharmaceutical product or with said one or more components, thus forming the content of the flexible container (2), the suction-discharge cavity (29), in communication with the inside space (5), being filled with said content, when the content of the flexible container (2) is to be mixed, the drive means (23) are used such that:

the movable part (28*a*) of the suction-discharge part (28) is displaced in at least one sequence of axially sliding alternately forwards and backwards, the volume of the suction-discharge cavity (29) follows at least one sequence of alternately compressing and expanding, and, in alternation, the content located in the suction-discharge cavity (29) is discharged into the inside space (5) through the suction-discharge opening (26) and the content of the inside space (5) is sucked into the cavity through the suction-discharge opening (26), the content of the flexible container (2) adjacent to the suction-discharge opening (26) is displaced, and in this manner the content of the flexible container (2) is mixed, and optionally comprising the following feature:

when stopping the use of the drive means (23), the suction-discharge part (28) is brought to its extreme forward position where it closes off the suction-discharge opening (26) and/or the drive means (23) are controlled as a function of a control parameter such as time or the degree of homogeneity/heterogeneity of the content of the flexible container (2) and/or said receptacle is used as a mixing vessel or as a bioreactor or as a freezing/thawing vessel.

23. Receptacle for biopharmaceutical use according to claim 5, wherein the transverse face (22*a*) is part of a rigid wall.

24. Receptacle for biopharmaceutical use according to claim 5, wherein the transverse face (22*a*) is rigidly secured, to lie flat, in a leaktight manner, to the flexible wall (4) by welding or adhesive bonding.

* * * * *